US006837017B2

(12) United States Patent
Hardy, Jr. et al.

(10) Patent No.: US 6,837,017 B2
(45) Date of Patent: Jan. 4, 2005

(54) APPARATUS FOR PLACING REBAR IN CONTINUOUSLY REINFORCED CONCRETE PAVING

(76) Inventors: Robert M. Hardy, Jr., P.O. Box 590206, Houston, TX (US) 77259-0206; Louis A. Waters, Jr., 4522 Teas St., Bellaire, TX (US) 77401

( * ) Notice: Subject to any disclaimer, the term of this patent is extended or adjusted under 35 U.S.C. 154(b) by 21 days.

(21) Appl. No.: 10/218,840

(22) Filed: Aug. 14, 2002

(65) Prior Publication Data

US 2004/0031228 A1 Feb. 19, 2004

(51) Int. Cl.[7] ..... E04C 5/16

(52) U.S. Cl. ..... 52/685; 52/686; 52/687; 52/741.41; 404/136

(58) Field of Search ..... 52/658, 677, 686, 52/687, 741.41, 689, 688, 680, 685, 745.13, 745.19, 745.2; 404/136, 135, 72; 248/316.1, 74.2

(56) References Cited

U.S. PATENT DOCUMENTS

| | | | | |
|---|---|---|---|---|
| 1,278,437 | A | | 9/1918 | Collings |
| 1,476,939 | A | | 12/1923 | White |
| 1,613,351 | A | | 1/1927 | Klinger et al. |
| 1,882,499 | A | | 10/1932 | Johns |
| 1,921,538 | A | | 8/1933 | Preist |
| 2,064,705 | A | | 12/1936 | Whitehead |
| 2,273,197 | A | | 2/1942 | Hillberg |
| 2,772,560 | A | | 12/1956 | Neptune |
| 3,105,423 | A | | 10/1963 | Reiland |
| 3,132,448 | A | | 5/1964 | Phillips |
| 3,378,981 | A | | 4/1968 | Horne |
| 3,623,289 | A | | 11/1971 | Lowery |
| 3,673,753 | A | | 7/1972 | Anderson |
| 3,693,310 | A | | 9/1972 | Middleton |
| 3,694,988 | A | | 10/1972 | Skold |
| 3,788,025 | A | | 1/1974 | Holmes |
| 4,007,572 | A | | 2/1977 | Ilukowicz |
| 4,063,397 | A | | 12/1977 | Follows |
| 4,110,951 | A | | 9/1978 | Padrun |
| 4,132,045 | A | | 1/1979 | Sullivan |
| 4,498,270 | A | | 2/1985 | Ilukowicz |
| 4,589,244 | A | | 5/1986 | Dreizler |
| 4,598,523 | A | | 7/1986 | Tolliver |
| 4,617,775 | A | | 10/1986 | Padrun |
| 4,655,023 | A | | 4/1987 | Yung |
| 4,800,702 | A | | 1/1989 | Wheeler |
| 4,835,933 | A | | 6/1989 | Yung |
| 4,840,334 | A | * | 6/1989 | Kikuchi ..... 248/73 |
| 4,942,714 | A | | 7/1990 | Langley et al. |
| 4,991,372 | A | | 2/1991 | Sonneville |
| 4,996,816 | A | | 3/1991 | Wiebe |
| 5,107,654 | A | | 4/1992 | Leonardis |
| 5,216,866 | A | | 6/1993 | Ekedal |
| 5,371,991 | A | | 12/1994 | Bechtel et al. |

(List continued on next page.)

FOREIGN PATENT DOCUMENTS

GB 2158848 A * 11/1985 ..... 52/677

OTHER PUBLICATIONS

Catalog p. 19 for "Bar Supports" accessed from http://www.americanhighwaytechnology.com/product.html.

Catalog p. 20 showing Snap–On Paving Chair, accessed from same address as cite 53.

*Primary Examiner*—Naoko Slack
(74) *Attorney, Agent, or Firm*—Tim L. Burgess

(57) ABSTRACT

A transverse bar assembly for use in constructing rebar mats for reinforcement of concrete paving includes a plurality of chairs and clips each having a lower portion that fixes to a transverse bar in the direction of its length and an upper portion for orthogonally receiving and holding locked in place a longitudinal bar, the chair also having a support extending to a base surface.

37 Claims, 14 Drawing Sheets

U.S. PATENT DOCUMENTS

| | | | | |
|---|---|---|---|---|
| 5,400,562 | A | | 3/1995 | Bahr |
| 5,408,799 | A | | 4/1995 | Ron |
| 5,509,636 | A | | 4/1996 | Cotugno |
| 5,555,693 | A | | 9/1996 | Sorkin |
| 5,595,039 | A | | 1/1997 | Lowery |
| 5,626,436 | A | | 5/1997 | Dragone |
| 5,664,390 | A | | 9/1997 | Sorkin |
| 5,699,642 | A | | 12/1997 | McDevitt, Jr. |
| 5,729,949 | A | | 3/1998 | Hartzheim |
| 5,791,816 | A | | 8/1998 | McCallion |
| 5,822,946 | A | | 10/1998 | Rasmussen |
| 5,878,546 | A | | 3/1999 | Westover |
| 5,893,252 | A | | 4/1999 | Hardy, Jr. |
| 6,089,522 | A | | 7/2000 | Haslem et al. |
| 6,112,494 | A | | 9/2000 | Hardy, Jr. |
| 6,161,360 | A | | 12/2000 | Smith |
| 6,212,848 | B1 | | 4/2001 | Cooper |
| 6,276,108 | B1 | | 8/2001 | Padrun |
| 6,279,274 | B1 | | 8/2001 | Amiet |
| 6,282,860 | B1 | | 9/2001 | Ramirez |
| 6,557,317 | B2 | * | 5/2003 | Sorkin ..... 52/684 |
| 6,663,316 | B1 | * | 12/2003 | Harris ..... 404/136 |

* cited by examiner

APPARATUS FOR PLACING REBAR IN CONTINUOUSLY REINFORCED CONCRETE PAVING

FIELD OF THE INVENTION

This invention relates to a system for erecting a reinforcing bar lattice structure (or "rebar mat") that is known to be used as a reinforcement and support for poured concrete in roadway construction, and more specifically to devices capable of supporting and securing longitudinal reinforcing steel rods at their designed location and spacing in such a manner as to prevent the rebar mat from being displaced from the designed position during concrete placement.

BACKGROUND OF THE INVENTION

Concrete has proven to be the preferred material for the construction of roadways in many locales. In such applications, however, concrete invariably develops cracks throughout the length of the concrete structure caused by the curing process, load induced stress, weather conditions, and other causes, so that the life cycle and the ride quality of the concrete road can become severely reduced unless some means is used to prevent the concrete from separating along these crack lines. One method commonly used for this purpose, known as continuously reinforced concrete paving ("CRCP"), incorporates deformed steel concrete reinforcing rods within the entire length of the concrete structure.

Deformed steel concrete reinforcing bar ("rebar") is used almost exclusively to provide structural reinforcement to concrete structures and is produced in accordance with national standards. It is formed using ferrous scrap metal as the principal raw material. The scrap metal is melted in an electric arc furnace, further processed in a ladle arc-refining unit, and the molten steel is then continuously cast into rectangular billets of steel that are cut to length. The billets are then rolled into various sizes of rebar, which is cut to various lengths depending on the customers' requirements. Deformed rebar is rolled with deformations on the bar, which provides gripping power so that concrete adheres to the bar, and the bar, thereby, provides reinforcing value to the concrete. The deformations include a horizontal rib where hot steel is squeezed out between rollers and various patterns of semicircular ribs spanning the longitudinal ribs, such ribs being referred to herein sometimes as raised elements on a transverse bar. The deformations must conform to certain requirements set out in the national standards. Bar designation numbers correspond to diameter and grade. National standards identify two grades of rebar, e.g. regular or "R" and weldable or "W". R grades are intended for general applications, while W grades are used where welding, bending or ductility is of special concern. National standards also identify yield strength levels.

Rebar used to reinforce concrete when paving highways is laid out and connected in a rectilinear grid structure called a rebar mat. Rebar that is designed to extend across the width of the highway lane is called "transverse" rebar, and rebar that is designed to extend along the length of a highway lane is called "longitudinal" rebar. Sometimes "bar" is used herein more for rebar to be laid in a direction transverse to the run of the road bed ("transverse bar") and "rod" more for rebar to be laid parallel to the run of the road bed ("longitudinal rod"). However, when speaking herein of rebar, the term "bar" is used interchangeably with "rod". No distinction is meant by the use of one term or the other. When cracks develop in concrete, the rebar mat performs the functions of holding the cracks tight, facilitating load transfer across the cracks, and providing stiffness by restraining end movement, thus preventing separation of the concrete and failure of the paving slab.

When designing highway specifications considering the type of road and local environmental conditions, civil engineers determine the optimum spacing of longitudinal rods laid out along transverse bars, the optimal spacing separating transverse bars, and the optimum height of a grid of transverse bars and longitudinal rods above the road bed within the concrete. In order for transverse and longitudinal reinforcing steel to effectively perform their function, the reinforcing steel must remain at its designed location within the concrete slab during and after concrete placement. This requires elevating the rebar mat to the designed height above the road base before the pour, and preventing the reinforcing bars of the mat from moving during the pour. Maintaining the correct height, spacing and shape of the rebar mat during the pouring process is critical to the performance of the completed pavement. A support system for rebar mats that can be imbedded in the concrete slab during the pour is an essential step to the construction of a continuously reinforced concrete roadway. Since the process of imbedding the support system in the concrete consumes the support, the support must be relatively inexpensive.

Most major concrete highway construction is done nowadays with a slip form paving machine that slips the concrete forms alone the sides of the roadway as the machine moves longitudinally along the new roadway structure being paved. The concrete mix used in slip form paving must be relatively dry so that while supported by the forms the concrete will set up sufficiently to hold its shape after the forms slip forward off the structure. This type of concrete mix has a dough-like consistency and is highly viscous and stiff. Great forces have to be applied to the concrete mix by mechanical spreaders and paving vibrators to push and work the stiff mix into place. These forces are in turn transferred by the mass of the mix onto the rebar mat. A support system for holding the rebar mat in its design location for the job to conform to engineering specifications must function to prevent the rebar in the mat from being displaced by the forces impressed on the mat during placement and working of the concrete mix.

One traditional method for erecting a rebar mat for CRCP roadway construction is to assemble the rebar mat in place, and then prop the mat to the design height above the road base. Using this method, the transverse rebar steel is laid out on the ground at the specified intervals. Some longitudinal rebar is then laid out on top of the transverse bars, and these transverse and longitudinal bars are wire tied together to form a template for the completed mat. The template rebar is then lifted up, and supports for the template, called "chairs", are placed under the transverse bars at the ends of the bars and at locations between the ends of the bars in a number sufficient to support the weight of the steel mat when it is completed. Remaining longitudinal rods are them placed on the elevated template at the design spacing and wire tied to the transverse bars to complete the assembly of the rebar mat.

However, this traditional system of forming and preparing a rebar grid for a concrete pour has several deficiencies. First, with a conventional chair support that props up the rebar mats, the steel simply "sits" on the support, hence origination of the term "chair". As the concrete mix is forced under the mat, the chairs are frequently pushed ("rotated") out from under the mat, causing inadequate support for sections of the mat or in extreme cases, allowing the entire mat to fall. Some means are needed to prevent the entire steel mat from moving or "walking" forward or being "racked" out of square as the stiff concrete mixture is worked into place. The traditional solution involves driving a metal stake into the ground at regular intervals to hold the mat in place. These metal stakes, however, can produce premature corrosion of the rebar steel by introducing a rust path to the mat steel and by providing a conductor for cathodic corrosion. Excessive corrosion of the rebar mat produces internal expansion forces that cause the entire concrete slab to crack and fail.

A recent improvement over the use of conventional paving chairs is described in U.S. Pat. Nos. 5,893,252 and 6,112,494, and employs a bar support device fixing transverse and longitudinal steel bars at their intersection with a locking cap that secures the device to the mat and at the same time holds the steel bars together. This system eliminates the need to wire tie the intersections of transverse and longitudinal bars where the support is placed and avoids the problems associated with use of conventional chairs described above. As a result, this chair improvement system has virtually replaced use of conventional roadway construction paving chairs in jurisdictions everywhere state highway departments allow use of wire tied rebar mats.

Some states not in sun-belt winter climates of U.S. do not permit the use of wire tied rebar mats. This is because in these states, winter road deicing considerations require that rebar steel must be coated with an epoxy resin to isolate the steel within a corrosion free environment. Epoxy coated steel has an extremely slippery surface compared to uncoated rough rebar, and in assembling rebar mats made of epoxy coated steel it is economically difficult to achieve a tight connection of the transverse and longitudinal bars by wire tying them together under the wage structure environments typically found on road and highway construction projects in these states. In view of this practical and economic difficulty, the states that require epoxy coated rebar typically specify erection of epoxied rebar mats using prefabricated, welded and epoxied transverse bar assemblies ("TBA's"). TBA's are constructed by spot welding a plurality of spaced open ended U-shaped clips to reinforcing steel bars that are to be placed on the road bed in the transverse direction. The reinforcing steel bars also have steel legs welded to the underside to support the bar at the desired height off the paving sub-base. After the clips and legs are welded to the rebar, the welded assembly is epoxy coated. The TBA's are then transported to the highway paving site, where workers lay them transversely to the run of the road bed to be paved, then place longitudinal bars in each U-shaped clip on top of the TBA's. The TBA legs are supposed to support the longitudinal bars at the designed height or clearance above the road base, and the U-shaped clips are supposed to locate the longitudinal rods at the engineered spacing along the span of the transverse bar and maintain that spacing during the concrete pour.

Epoxy coating of the TBA's has proven problematical. The irregular shape of the weld joints where the U-shaped clips and the bases are affixed to the transverse bar makes achieving a complete epoxy seal of this part a practical impossibility. Further, welding the U-shaped clips and legs to the rebar steel presents a problem at the pour site unique to TBA's. Rebar steel typically has a high carbon content, making it difficult to obtain a solid welded joint, and this is exacerbated with spot welded U-shaped clips, because these have a small steel-to-steel contact area for the weld. At the pour site, laborers laying out the grid for the reinforcing mat drop the longitudinal bars onto the U-shaped clips, sometimes with enough drop force to break the weld, causing the U-shaped clip to fall off the TBA. The site where the clip is missing allows the unrestrained longitudinal bar to displace laterally at that position. Moreover, breaking off the U-shaped clip exposes bare metal to the potentially corrosive environment. The spot weld holding the TBA legs to the TBA rebar is subject to much the same weld weakness as the clips, and the legs can snap-off.

The TBA approach to rebar layout and erection has the same problems of rebar mat instability and potential for corrosion that occurs where rebar mats are wire tied and conventional rebar support chairs are used. The clips on the TBA do not fix the longitudinal bars to the transverse bar. The longitudinal bars merely sit in the clips. Thus the design of the TBA affords no means for preventing the forces of concrete mix placement from pushing or "walking" a TBA, and consequently, does not assure that the engineered spacing between transverse bars is maintained during paving. Loss of specified transverse bar spacing creates the possibility of excess longitudinal rod sagging from lack of design interval support. Further the non-locking design of the TBA affords no means for preventing the forces of concrete mix placement from angularly "racking" a TBA out of square into a shape that has less effective reinforcing capacity and that misaligns longitudinal rod ends from positions designed for attachment to the next adjoining section of rebar mat. Still more, the design of the TBA allows the legs of a TBA to be pushed or rotated out from under the longitudinal steel in the mat, leaving the longitudinal steel not only vertically unsupported where they are supposed to be supported, but also, due to the rotation of the support out from under the longitudinal rebar, allows the clips welded to the transverse bar to rotate out from under the longitudinal rods, releasing them from restricted lateral movement. In order to mitigate this potential for "walking" or "racking" of the mat or "rotation" of the TBA out from under the mat, paving contractors frequently employ the same staking process described above with conventional paving chairs used with wire tied rebar mats. This produces the same potential for cathodic corrosion and a rust path from outside the concrete structure to the rebar mat within the concrete for attack where any steel is exposed by incomplete coating or by broken and knocked off clips.

Any cost savings on Field labor realized by a paving contractor using TBA's rather than conventional paving chairs is more than offset by the cost of the fabricated TBA's. Large scale production spot welding of the U-clips and triangular bases to transverse reinforcing steel bars can be accomplished economically only by deployment of sophisticated robotics welding equipment, at a very large initial capital cost. Moreover, epoxy coating of fabricated TBA's requires a special method and coating chamber not required for epoxy coating unwelded reinforcing steel bars. As a result of the manufacturing costs, the total cost of building a CRCP roadway with TBA's may actually exceed the higher labor costs associated with wire tying if paving chairs were used, yet provide little practical performance improvements during the concrete placement.

SUMMARY OF THE INVENTION

An object of this invention is to provide an alternative rebar chair support to that of U.S. Pat. Nos. 5,893,252 and 6,112,494 that provides similar benefits but avoids the need for a locking cap.

An object of this invention is to provide a chair support that may be used to erect and support a rebar mat used in paving highways where some longitudinal rebar is wire tied to transverse bars.

Another object of this invention is to provide an alternative to TBA's where wire tying of rebar mats is not desired, preferred or permitted, and more particularly, to provide a simple and inexpensive rebar support structure that will accurately locate and hold in place longitudinal rebar in a rebar mat without wire tying.

A further object of this invention is to provide a chair support structure that may be used to erect and support a rebar mat used in paving highways where some longitudinal rebar is wire tied to transverse bars, yet also serve as a component in an alternative structure to traditional TBA's in places where wire tying of rebar mats is not desired, preferred or permitted, thus providing a dual purpose structure that will support and accurately locate and hold in place longitudinal rebar in a rebar mat when used alone in places where wire tying is permitted or when used as a component in such alternative structure in places where wire tying in not permitted.

A further object of this invention is to provide structure that will lock together transverse and longitudinal rebar for assembly of a rebar mat and that will prevent "walking", and "racking" of the mat and rotation of the structure out from under the mat.

A further object of this invention is to provide structure for anchoring a rebar mat without creating a rust path to the rebar mat.

A further object of this invention is to provide common structure for capture and locking in place of longitudinal rebar along a transverse bar useful both in a support for a transverse bar and as a clip on a transverse bar, affording a more economical cost of manufacture.

These and other objects of the invention are accomplished in this invention by a novel mechanism adapted to be fixed to a transverse rebar rod for capture of a longitudinal rebar rod. The novel mechanism seats and locks the longitudinal rebar rod to the transverse bar for assembly of a rebar mat. The novel capture and locking mechanism minimally is part of a chair support structure for the transverse bar. In the chair embodiment of the invention, the structure includes a support extending downwardly from the body for spacing the body above a base. This may be a single leg or a plurality of legs, and if the latter, may include bracing connecting the legs. This chair support may be used where wire tying of other longitudinal rebar to the transverse bar is desired.

The novel capture and locking mechanism also may be included in a saddle clip that is carried on the transverse bar to accept and hold longitudinal rebar in lieu of tying the longitudinal rebar to the transverse bar.

In combination the transverse bar chair structure and the saddle clip may be used to make a new kind of TBA assembly not fraught with the manufacturing costs and pour site failings of conventional TBA's.

The capture mechanism of this invention locks the transverse and longitudinal rebar so effectively that the new chair prevents "walking" and "racking" of a rebar mat assembled using the capture mechanism and prevents rotation of the structure out firm under the mat (assuming wire tie of the intersections of transverse rebar and longitudinal rebar not harnessed by the capture mechanism). This eliminates the need for a stake to anchor the rebar mat that has been a source of a corrosion path to the rebar mat. Additionally, the preferred material for the new support chair of this invention is an injected molded plastic. This eliminates another potential source of a corrosion path the rebar mat, because plastic is not susceptible to corrosion.

The saddle clips of this invention that use the novel capture mechanism may be attached directly to rebar by thermal deformation and may be specially configured to bond to epoxy coated rebar. When epoxy coating is required, the steel bar can be coated in the customary manner for coating rebar, assuring a complete epoxy skin, and the plastic chair and saddle clip components can be attached to the epoxy coated rebar. This not only avoids all of the complexity of robotic welding and epoxy coating an assembly of stands and clips spot welded to a length of rebar, significantly reducing the cost of fabricating TBA's prior to delivery to the job site, but also eliminates corrosion tissues inherent in conventional welded TBA units.

These and other advantages of the invention will become more evident from the description of the invention, which follows.

In accordance with this invention, there is provided a novel capture and locking apparatus for use in holding rebar in position for receiving a concrete pour. The novel apparatus can be in a chair or on a saddle clip for a transverse rebar rod. There is provided a novel transverse bar assembly that employs the novel chair and saddle clip apparatus. There is provided a new form of rebar mat including the novel chair, transverse rebar rods and longitudinal rebar rods. There is provided a new form of rebar mat comprising the novel transverse bar assemblies and longitudinal rebar rods. There is provided new modes of paving continuously reinforced concrete paving making use of these two new types of rebar mats.

The capture and locking apparatus for use in holding rebar comprises a body including (a) a horizontal bed having an axis oriented in a first axial direction and sides to receive transverse rebar in the first axial direction, (b) at least one upwardly open horizontal seat having an axis stationarily oriented in a second axial direction orthogonal to the first axial direction, the seat having opposing sides and being positioned above the bed sufficiently to permit a longitudinal rebar rod to sit in the seat such that the longitudinal rebar is located immediately above the transverse rebar and oriented in the second axial direction, and (c) at least one crook staff on one side of the at least one seat and at least one crook staff on a side of a seat opposite the one side, staff portions of the crook staffs each extending above the seat to transition to crook portion of the crook staffs, the crook portions extending downwardly toward a seat, said downwardly extending crook portions being spaced from said staff portions, the downwardly extending crook portions being resiliently deformable toward the staff portions to vertically pass between them to be seated in a seat a downwardly forced longitudinal rebar rod extending in the direction of the axis of a seat, the downwardly extending crook portions of the crook staffs returning resiliently to an undeformed position after passage of the longitudinal rebar rod therebetween, the crook portions compressively and the staff portions tensilely resisting movement of a seated longitudinal rebar rod out of a seat.

The mechanism for holding the longitudinal bar in the longitudinal bar seat is, as said, included in the bodies of the chair and/or the saddle clip pieces that are for attachment to the transverse bar. The shape of the crook staff loosely resembles an inverted "j". The vertical shaft portion is analogous to the staff of a "j" and the downwardly inwardly extending portion is analogous to the hook of the "j" except in this case, with the "j" inverted, the tip of the hook points down, not up, and the arm of the hook is extended. The downwardly inwardly extending arms of the crook staffs project toward the longitudinal bar seat and end in tips that are spaced above the floor of that seat. The spacing of the tips above the floor of that seat is a distance at least as wide as the diameter of any longitudinal rod which the seat is sized to accommodate. The crook staffs are formed of a material that permits the crook portions of the crook shafts to deflect away from each other and towards their staff or staff portions above the seat (that is, away from an imaginary vertical midline projected above a center of the seat) to allow a longitudinal rod to be pressed past the crook arm portions and be put into place in the seat. The material of the crook stalks allows the crook portions of the crook staffs to spring or snap back to the undeflected position once the longitudinal bar clears the tip ends. The length of the downwardly extending portions of the crook part of a crook staff ending in the tip must be long enough to be able to oppose movement of the seated longitudinal rod out of the seat, but not so long as not to clear the rod and not rebound to the undeflected position occupied before the longitudinal rod was forced into the seat between the crook portions of the crook staff. The angle to vertical of the down turned arm portion of the crook staff, positioned for contact with a longitudinal bar received in the longitudinal bar seat, is such that the crook portion of the crook staff receives and counter-exerts a compressive force and the staff portion of the crook staff receives and counter-exerts a tensile force from and to the longitudinal bar to maintain a seated longitudinal bar in its seat. The crook staffs are thus arranged to avoid moments of force that would bend outwardly the staff portions of the crook staffs and allow the longitudinal rod to be come unseated and escape capture the means. The crook staffs that capture and hold the longitudinal bar seated therefore act as a "one-way trap" for the longitudinal bar.

Plastic is the preferred material for the chair and saddle clip pieces of this invention applied to a transverse bar, and plastics with very high tensile strengths can be selected for injection molding of the pieces of this invention. An angle of the down turned arm portion of the crook staff suitably may be from about zero to about 30 degrees to vertical, advantageously from about zero to about 20 degrees to vertical, and most advantageously from about zero to 15 degrees, for example, about 12 degrees is quite satisfactory. The smaller the angle, the lesser is a bending moment that can be impressed upon the staff portion of the crook staff.

Depending on the particular embodiment of a crook staff element in accordance with this invention, it may be helpful to add strengthening ribbing to the staff portion of the crook staff to resist a bending moment on the staff. Thus staff portions of the crook staffs suitably may include vertical ribbing to stiffen the staff portions against bending moments when a longitudinal rebar rod is forced downwardly between the crook staffs to seat such rod in a the seat and to maintain force vectors predominantly along the length of the staff for tensile counter-resistance to force vectors that would work to unseat a seated longitudinal rod. In an embodiment, such ribbing is curvilinear with the maximum curve projection at an elevation where maximum bending moment would be expressed, and in a particular embodiment, the maximum projection is adjacent the sides of the seats.

The capture arid hold "one-way trap" mechanism far a chair in places where wire tying of longitudinal bars is permitted does not have require a clasp or non-rotative hold of the transverse bar in the transverse bar bed. If a concrete pour mass attempts to rotate the chair out from under the transverse bar, the tips of the crook staffs of the chair are immediately brought into contact with, and press on the longitudinal bar beneath the crook portions of the crook staffs. The longitudinal bar, anchored in a rebar mat to another transverse bar, and unable to move past the tips of the crook staffs, exerts a compressive counter-force against the crook portion of the staffs that puts a tensile force on the staff portion of the crook staffs, which, being part of the chair body, prevents the chair from rotating on the axis of the transverse bar, keeping the chair legs under the transverse bar. Thus the "one-way trap" mechanism of the invention causes the longitudinal bar to resist the forces impressed by the concrete mass and maintain the legs of the chair under the transverse bar.

In an embodiment of the invention in which the chair is incorporated into a fabricated transverse bar assembly, the chair also may rotate on the transverse bar bed; the counter-forces described for the "one-way trap" will work there just as where the chair is used without incorporation into a fabricated transverse bar assembly. As an aid to easing layout of the transverse bar assembly at the paving site, it is advantageous, however, to cause the chair bed to clasp the transverse bar so the chair does not rotate with respect to the transverse bar assembly. In such an embodiment, the non-rotation of the chair about the transverse bar axis adds further rigidity to the assembly. If an external force vector tends to pivot the seated longitudinal bar around the axis of the transverse bar, or if an external force vector tends to rotate the transverse bar on its axis with respect to the longitudinal bar, the tip end of the crook portion of the crook staff and the longitudinal bar contact and cooperate to oppose the external vector. Thus, in the case of an external force vector tending to rotate the transverse bar around its axis, such as when the push of the cement mix mass would work to move an affixed chair out from under the transverse bar, the crook tips of the chair are immediately brought into contact with, and press on the longitudinal bar beneath the crook portions of the crook staffs. The longitudinal bar, anchored in a rebar mat to another transverse bar and unable to move past the crook tips, exerts a compressive counter-force against the crook portion that puts a tensile force on the staff portion of the chair body, which, being non-rotationally attached to the transverse bar, transfers the counter-force from the longitudinal bar against the force vectors pushing against the chair legs, keeping the chair legs under the transverse bar. In the case of a force tending to pivot the longitudinal rod about the transverse bar, the longitudinal bar comes into contact with the tips of the crook staff of the body non-rotationally attached to the transverse bar, and the clip crook staffs transfer the moment of force received from the longitudinal bar through the body to the transverse bar, which is restrained from rotational by the grid in which it is fixed, so the transverse bar exerts a counter-force conveyed by the body crook staffs against the force vector acting on the longitudinal rod, resisting movement of the longitudinal bar.

A multitude of chairs and saddle clips are attached to a transverse bar assembly. When a rotational vector is imparted, the rotation resistant forces of the crook staff mechanism of one piece are joined by the rotation resistant forces of the crook stall mechanisms of other pieces along the transverse bar, summoning resistance against rotation at every piece where any rotational vector occurs, so that each adjacent piece supports the resistance mounted by its neighboring piece, with the effect that resistance to rotation is summoned and mounted in proportion to the strength of the rotational vector confronting the affected pieces. This enables the transverse bar assembly when placed in a grid mat, as designed, to resist the great lateral forces that work to displace transverse bar assemblies and mats during placement of the stiff concrete mixes encountered with slip form pavers and other current highway building technologies.

Thus the crook staffs in cooperation with the remainder of the body in which they are part makes the grid system of a rebar mat that employs the apparatus of this invention work cooperatively with the apparatus to resist "walking" or racking" of the mat and "rotation" of the chairs out from under the mat or the mats from off the chairs.

An embodiment of the invention may comprise a plurality of the longitudinal rebar seats and the crook staffs may be arranged along the sides of the seats not to oppose one another. Another embodiment may have the crook staffs arranged along the sides of a seat to oppose one another. An embodiment comprising a plurality of the seats may have opposing crook staffs for each seat.

Moving from description of the longitudinal bar seat and crook shank to a description of the transverse bar bed, the transverse bar bed may be a passage through the body for axial insertion of the transverse bar, or it may be substantially semicircular, opening upwardly, with outer and inner surfaces, shaped and sized to receive a transverse bar. If it is the through passage, the bed includes a horizontal tubular extension from the body that is thermally deformable around a transverse bar inserted through the bed to acquire a configuration matingly complementary to the surface configuration of the transverse bar under the extension. In an embodiment, the tubular bed comprises two coaxial tubular segments spaced apart a distance sufficient to permit a transverse bar resting in the bed and a longitudinal bar sitting in the seat to directly contact each other to resist forces which if unresisted would move the body, as described above.

If the transverse bar bed is substantially semicircular, opening upwardly (sometimes referred to herein as the "cradle" configuration), the bed suitably has linear edges along the sides of the saddle and a basal portion intermediate the edges. In an embodiment, the cradle bed suitably includes flats or tie surfaces exteriorly of the bed for tying the transverse bar to the bed. The cradle bed suitably includes surface configurations for cooperation with a bonding agent for fixing the transverse bar received therein against movement in the bed. Where the transverse bar has a defined surface configuration, the cradle bed suitably has at least one facility for providing structure complementary to the surface configuration of the first longitudinal bar for preventing movement of the body relative to the first longitudinal bar.

In the saddle clip aspect of the invention, the bed may be tubular or may be a substantially semicircular saddle for sitting on the first longitudinal bar. In the latter configuration, the saddle is similar to an inverted cradle bed. It may include tie surfaces exteriorly of the bed for tying the bed to the first longitudinal bar, it may include surface configurations for cooperation with a bonding agent for fixing a first longitudinal bar received therein against movement in the bed, and it may have at least one facility for providing structure complementary to the surface configuration of a transverse rebar having a defined surface configuration for preventing movement of the body of the invention relative to the transverse rebar first longitudinal bar.

Where the bed of a saddle clip is tubular, the bed comprises an upper vacation of size to permit a transverse rebar resting in the bed and a longitudinal rebar sitting in the seat above the bed to directly contact each other to resist forces which if unresisted would move the body. In embodiment as a tubular configuration, the bed is thermoplastic and longitudinally distal portions of the bed are thermally deformable around a first longitudinal bar axially received in the bed to acquire a configuration matingly complementary to the surface configuration of the first longitudinal bar.

In the saddle clip aspect of the invention, the saddle straddles and rides on the transverse bar; preferably it is shaped and sized such that the edges confront diametrically opposed longitudinal ribs of a transverse bar to center the basal portion of the saddle on the transverse bar with the crook shanks in vertical orientation when the longitudinal ribs of the transverse bar are horizontal. The edges of the saddle may be conformed to ride on the longitudinal rib of the transverse bar.

In the chair, the cradle bed receives and cradles the transverse bar from the top. In the support or stand piece, the saddle is inverted to receive and cradle the transverse bar from the top; the sides of the cradle extend upwardly from the basal portion of the cradle for receiving within the sides at least a lower portion of a transverse bar, and the longitudinal ribs of the transverse bar may ride on the edges of the cradle.

The chair and/or the saddle clip may include tie surfaces exteriorly of the bed for tying the bed to the transverse rebar rod. Cable ties alone may provide sufficient strength to prevent the parts from rotating and lateral movement so that an adhesive may not be required. Strong enough cable ties, pulled to a sufficient tightness (in an embodiment, for example, about 100 lbs) will prevent movement with lighter steel mats.

The saddle or cradle configuration of the bed for the transverse rebar suitably has at least one facility for providing structure complementary to the surface configuration of the transverse bar, to obstruct rotation of the saddle about the axis of the transverse bar when the transverse bar is conformingly received therein. This structure may include at least one depression in the inner surface of the saddle or cradle bed. Suitably the at least one depression comprises at least one channel in a basal portion of the inner surface, and advantageously the at least one channel extends in the axial direction of the transverse bar. More advantageously, the channel includes at least one portion wider than a least wide portion of the channel. In assembly of a body to the transverse bar, an adhesive adherent at least to the steel, such as an epoxy, if the steel is not already coated with epoxy, but if already coated, an adhesive compatible at least with the epoxy, or if already coated but not with epoxy, then an adhesive compatible at least with that other coating, is applied to the inside of the saddle or cradle bed including in the depression(s), suitably the channel(s), and in the widened portion(s) of the channel(s). In speaking of an adhesive "at least" compatible with the steel or a coating already covering the steel, it is recognized that some adhesives may bond to the steel or to the coating covering the steel but not bond to a thermoplastic plastic suitable for use in this invention. Use of an adhesive that will set up and bond to both the surfaces being married is preferred, but the invention is designed to permit use of an adhesive that will not bond to the surface of an injection molded plastic. Thus, on hardening, the adhesive bonds at least to the steel or epoxy coating (or other coating) and, in the event the adhesive is not adherent to the material of the stand piece or clip piece, the portion of the adhesive hardened and projecting into the depressions of the piece will resist lateral movement of the clip along the transverse bar, and also will resist rotation of the piece around the transverse bar or the transverse bar on the piece. Thus, in the instance of a channel parallel to the axial direction of the transverse bar, the adhesive hardens forming a rail that is fixed in the slot given by the channel, and this provides an obstruction to rotation of the piece around the transverse bar or the transverse bar on the piece. Similarly, the widened area of the channel of the piece will host a protuberance bonded to the transverse bar that will resist movement of the piece on the transverse bar. Depressions transverse to the axial direction of the transverse bar resist movement of the piece along the axial direction of the transverse part and maintain desired spacing between adjacent pieces.

The structure for the saddle or cradle bed complementary to the surface configuration of the transverse bar suitably includes a plurality of raised structures on the inner surface of the saddle or cradle bed. The raised structure may comprise a pair of spaced nibs adjacent each of the edges. Application of the adhesive to the inside of the saddle or cradle bed that bonds to the epoxy coating of the transverse bar nestled in the saddle or cradle bed and does not bond to the material of the saddle or cradle bed leaves raised structures such as the nibs on the saddle or cradle bed surrounded by a rigid structure formed of hardened adhesive bonded to the epoxy coating of the transverse bar. The raised structures resist rotational and axial movement of the piece relative to the transverse bar and resist rotational and axial movement of the transverse bar relative to the piece.

Thus either in the instance of a tubular bed which receives a transverse bar inserted axially therein and is then heat deformed in part to conform to the configuration of the bar, or in the instance of a saddle or cradle bed having inner structures that interact with an adhesive bonded to the steel or a coating already on the steel, the transverse bar is conformingly received by the bed of the saddle or cradle bed or clip piece.

As mentioned, the edges of the saddle or cradle bed may aid in alignment of the saddle or cradle bed on the transverse bar after adhesive is spread on the inside surface of the saddle or cradle bed. In such an embodiment, the edge of the saddle or cradle bed rests on the longitudinal rib of the transverse bar (in the case of the clip piece) or braces the longitudinal rib of the transverse bar (in the case of the support piece).

When mounting a saddle or cradle bed piece to a transverse bar after adhesive has been placed on the inside of the saddle or cradle bed, the piece is advantageously tied to the transverse bar by a wrap extending around both the piece and the transverse bar. A plastic tie wrap of the continuously cinching type is quite suitable for this purpose. The tie wrap not only maintains the piece securely in place while the adhesive sets up, but in addition, there being no need to remove it after the bond has formed, the tie further aids in providing resistance to forces that would cause rotational or axial displacement of the pieces before the transverse bar has been made more rotation resistant by insertion of longitudinal bars at the paving site. In order to facilitate the tightness of the tie wrap, the saddle or cradle bed axially extends a distance past the seat for the longitudinal rod and the outer surface of the saddle or cradle bed includes flats shortening the perimeter around the saddle or cradle bed to afford a tighter binding for a tie extending around the outer surface over a transverse bar received in the saddle or cradle bed.

The invention will be further understood from a detailed description of several embodiments taken in conjunction with drawings that illustrate the embodiments. It is to be understood that the described embodiments illustrate particular ways of making and using the invention, but the invention is not limited to these embodiments.

DETAILED DESCRIPTION OF EMBODIMENTS OF THE INVENTION

In describing the novel longitudinal bar capture and locking structures of this invention, the transverse bar chair embodiment and the transverse bar saddle clip embodiment will be described initially in connection with a new type of TBA for use at least in places where wire tying of longitudinal rebar is not favored. This facilitates economy and completeness of description, since describing the transverse bar chair and its operation in that context also describes the structure of the transverse bar chair which can be used in a standalone capacity in places where wire tying of longitudinal rods to transverse bars is permitted. In those places, the transverse bar saddle clip is not needed.

Figure 1:
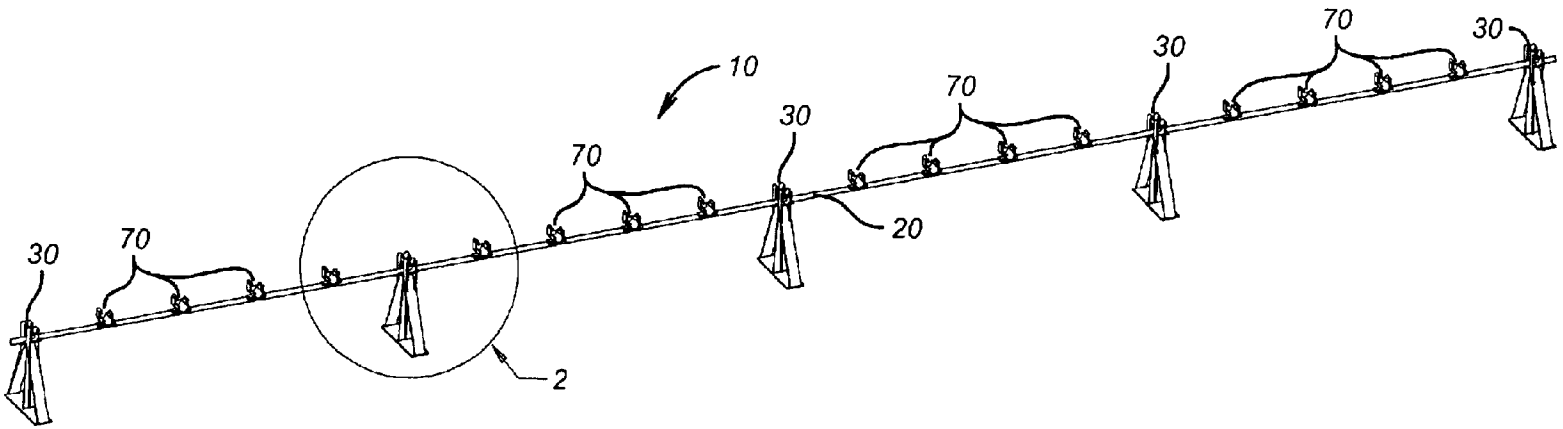
FIG. 1 is a perspective of a transverse bar assembly assembled with a transverse bar and embodiments of a chair and a saddle clip of this invention.
Figure 12:
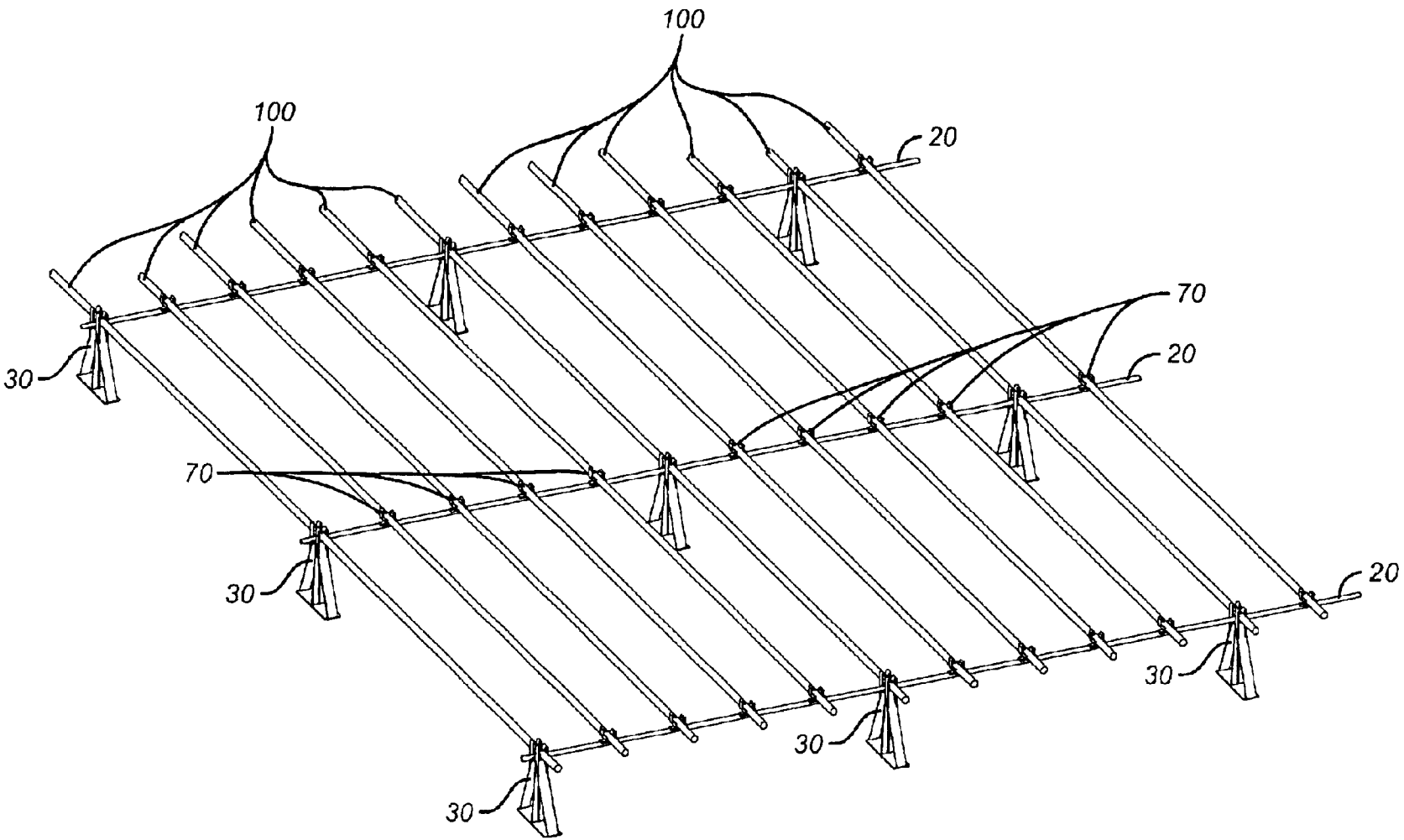
FIG. 12 is a perspective of a novel rebar mat portion comprising transverse bar assemblies of this invention making use of the embodiments of the chair and saddle clips depicted in FIGS. 2-11.
Figure 13:
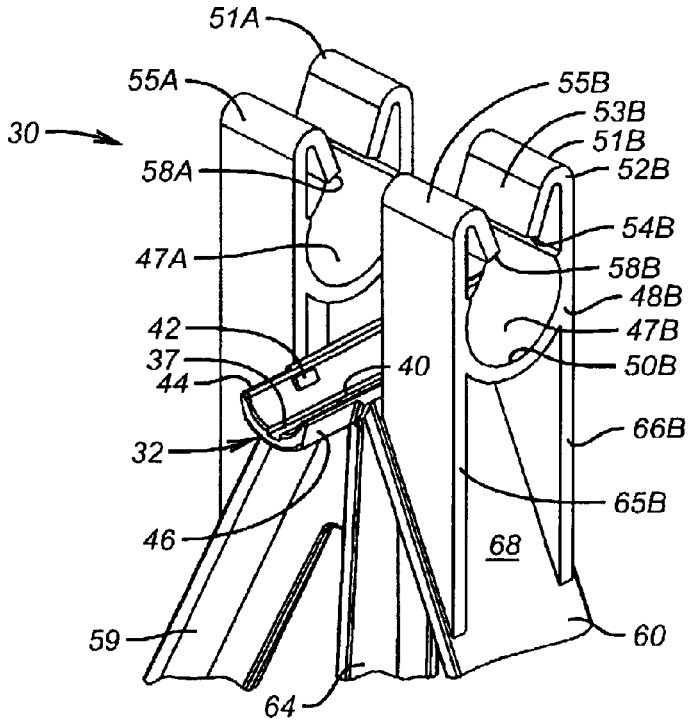
FIG. 13 is a perspective view in the same orientation as FIG. 4 showing a variant embodiment of a chair of this invention.
Figure 14:
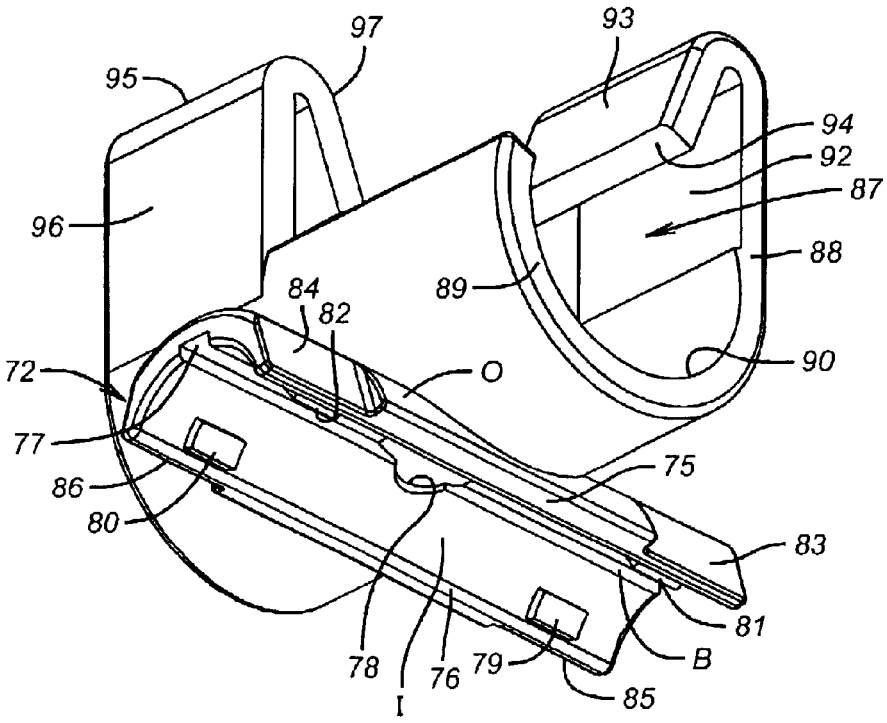
FIG. 14 is a perspective view in the same orientation as FIG. 8 showing a variant embodiment of a saddle clip of this invention.
Figure 15:
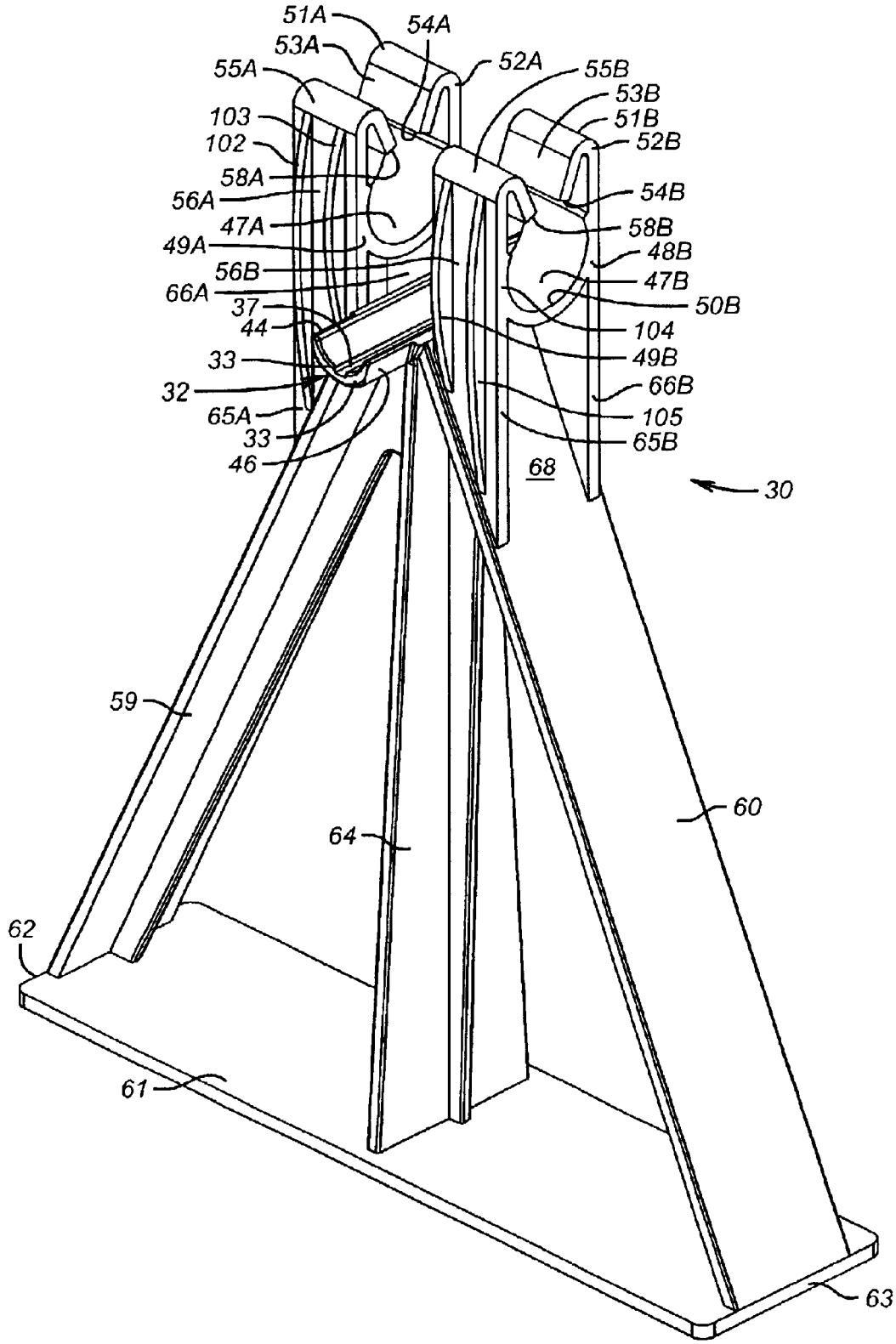
FIG. 15 is a perspective view in the same orientation as FIG. 4 showing a variant embodiment of a chair of this invention in which curvilinear ribs are depicted.
Figure 18:
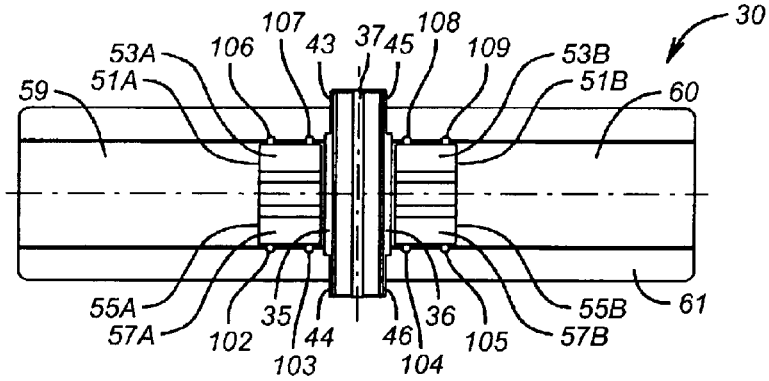
FIG. 18 is a top plan view of the chair of FIG. 15.
Figure 16:
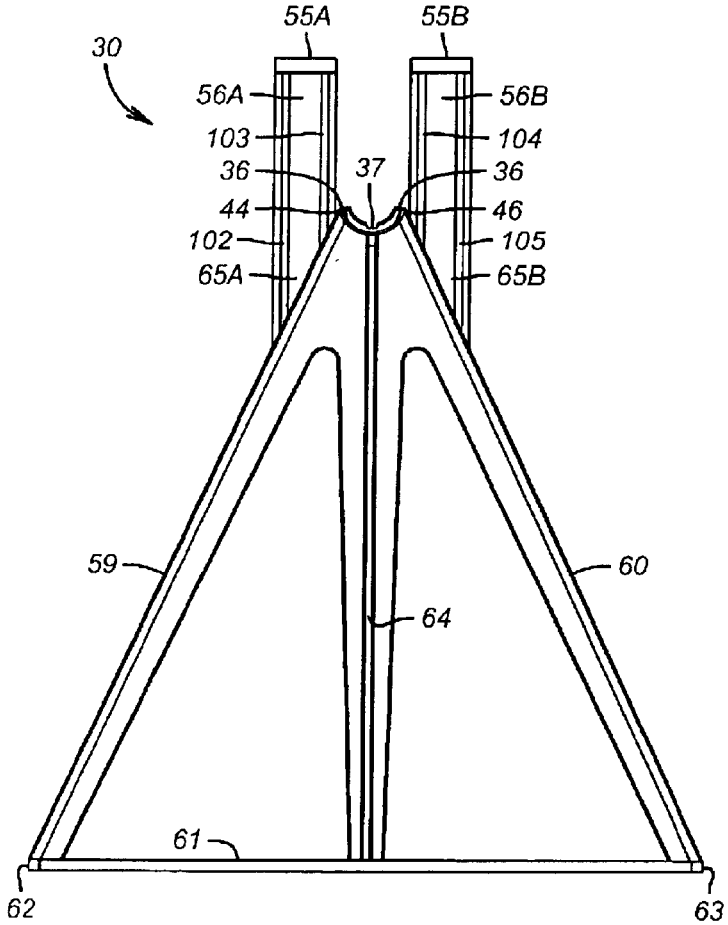
FIG. 16 is an end view of the chair of FIG. 15.
Figure 17:
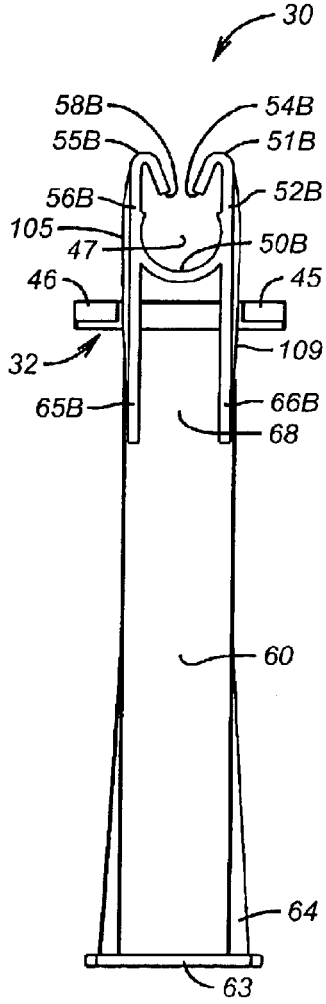
FIG. 17 is a side view of the chair of FIG. 15.

Referring to FIG. 1, a transverse bar assembly comprising apparatus of this invention for use in holding crossing reinforcing rods in position at an intersection for receiving a concrete pour is referenced generally by numeral 10. Transverse bar assembly 10 includes transverse bar 20, which is an elongate reinforcing bar of defined surface configuration, and a plurality of the apparatus members of this invention comprising transverse bar chairs 30 and saddle clips 70. For a nominal twelve foot wide lane of a highway road bed base across which the bar 20 is arranged transversely to the longitudinal direction of the bed, five chairs 30 support the transverse bar 20, two chairs 30 at the ends of bar 20, and three chairs 30 spaced equally between the end chairs, thus dividing the bar into four three foot segments. Interspersed at equal spacings between the stands 30 are saddle clips 70. The number of saddle clips 70 depends on the number of longitudinal rebar rods to be placed in a mat. The chairs 30 and the saddle clips 70 each include common components for the purpose of holding longitudinal rods 100 and for fixedly mounting the pieces on the transverse bar 20. Refer to FIG. 12 for a depiction of a mat of rebar formed using the transverse bar assembly of this invention and longitudinal rebar rods 100.

Figure 2:
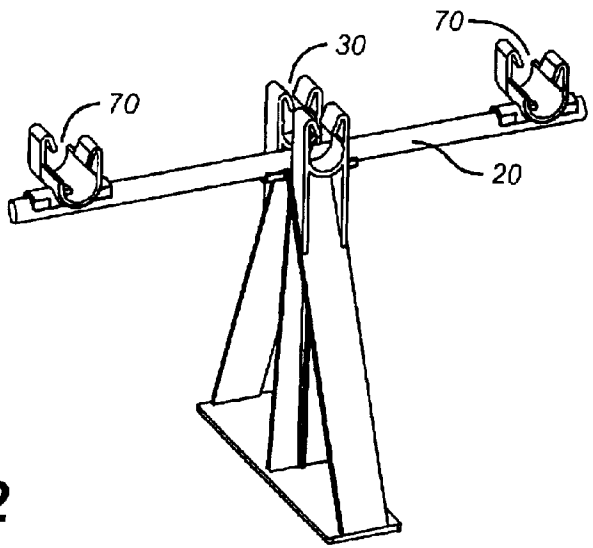
FIG. 2 is a perspective view of a portion of the assembly of FIG. 1, enlarged in size from the encircled portion 2 of FIG. 1 showing in larger detail these embodiments of the chair invention and the saddle clip invention.
Figure 3:
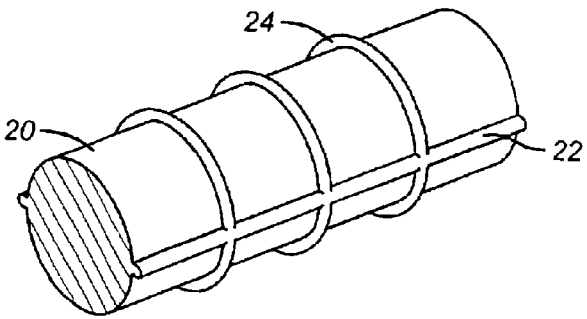
FIG. 3 is a perspective view of typical deformed steel used as transverse or longitudinal reinforcing rods in a rebar mat.
Figure 4:
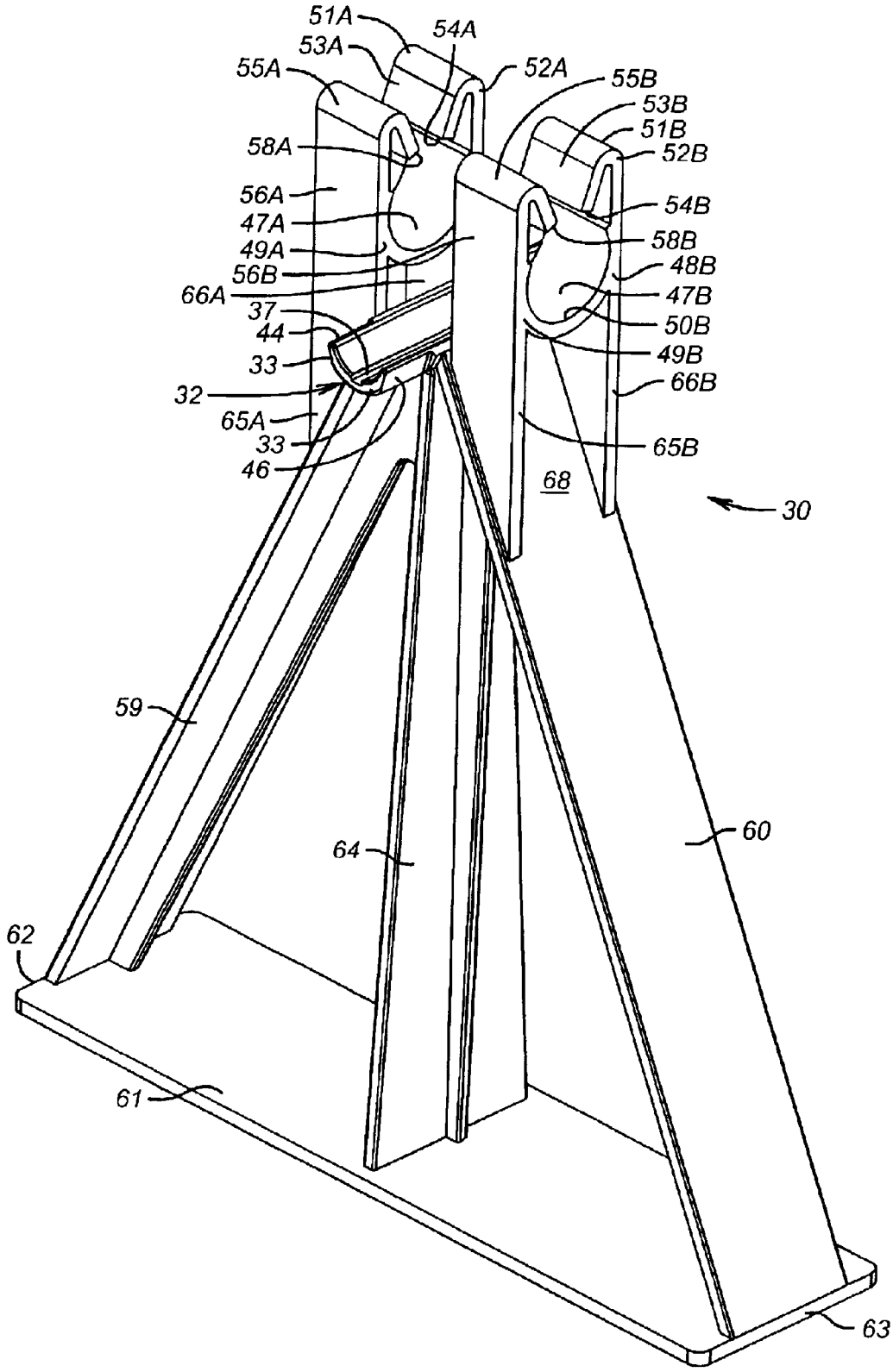
FIG. 4 is larger and different perspective view of a chair embodiment of the type illustrated n FIG. 2.
Figure 7:
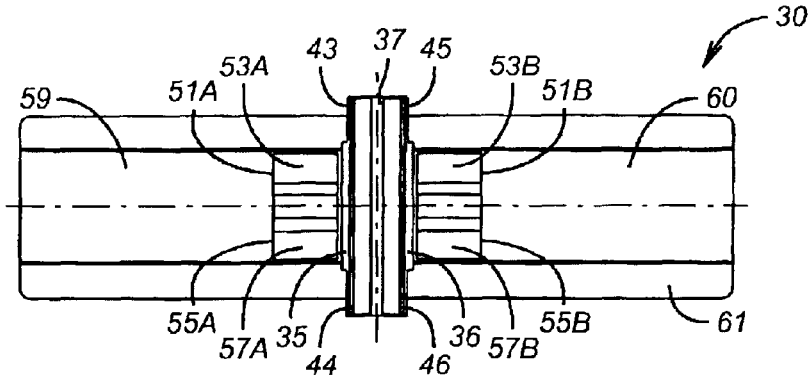
FIG. 7 is a top plan view of the chair of FIG. 4.
Figure 5:
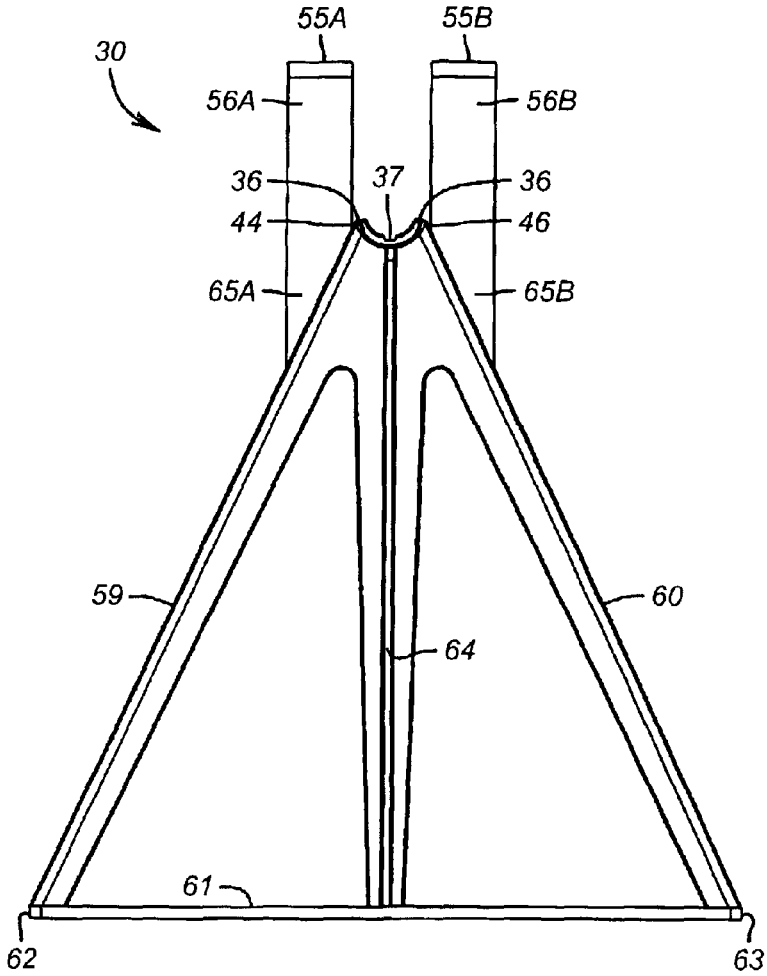
FIG. 5 is an end view of the chair of FIG. 4.
Figure 6:
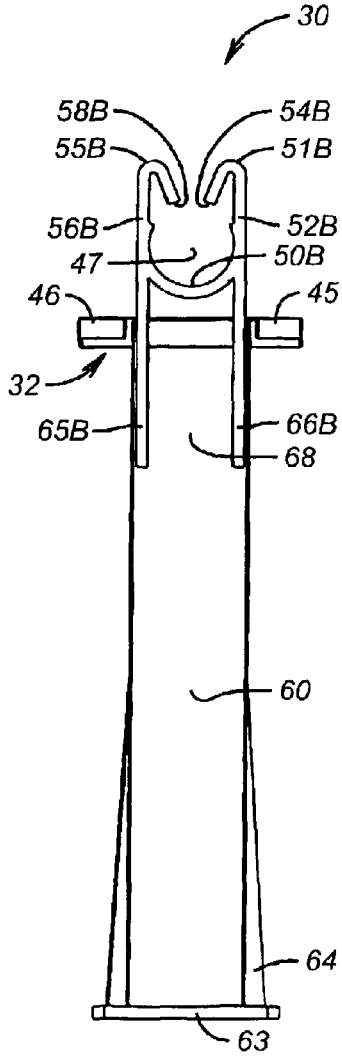
FIG. 6 is a side view of the chair of FIG. 4.

FIG. 2 shows an enlarged view of a chair 30 and two saddle clips 70 on transverse bar 20. The body of chair 30 is indicated by numeral 30 and the body of saddle clip 30 is indicated by 70. FIG. 3 shows a typical deformed steel concrete reinforcing bar ("rebar") having a defined surface configuration comprising diametrically opposed longitudinal ribs 22 and a circumferential rib 24. A convention is employed hereinafter in describing common structure in the chair 30 and saddle clip 70. Structure in the chair which is common to structure in the saddle clip has the number of the structure in the saddle clip minus 40. Thus structure 32 of the chair is the same as structure 72 of the saddle clip. Arabic letters the same in both the chair 30 and the saddle clip 70 indicate the same structure. This saves redundancy of description, and the reader will understand the structure of one by reference to the other, adding or subtracting "40". Thus an element obscured from view in one piece may be understood from view of the corresponding common element in the other piece.

Each body of the apparatus, whether a chair 30 or a saddle clip 70, includes a horizontal bed for conformingly carrying transverse bar 20 in a direction along the axis of bar 20. As mentioned above, the invention comprehends these bodies 30 and 70 having a horizontal bed including opposing round sides for receiving in an axial direction and at least anti-rotatively fastening an elongate transverse bar. In the embodiments depicted in FIGS. 1-19, the bed is an open ended and upwardly open semicircular cradle structure 32 for the chair (FIGS. 4-7, 13) and an open ended and downwardly open saddle structure 72 for the saddle clip (FIGS. 8-11, 14).

Figure 8:
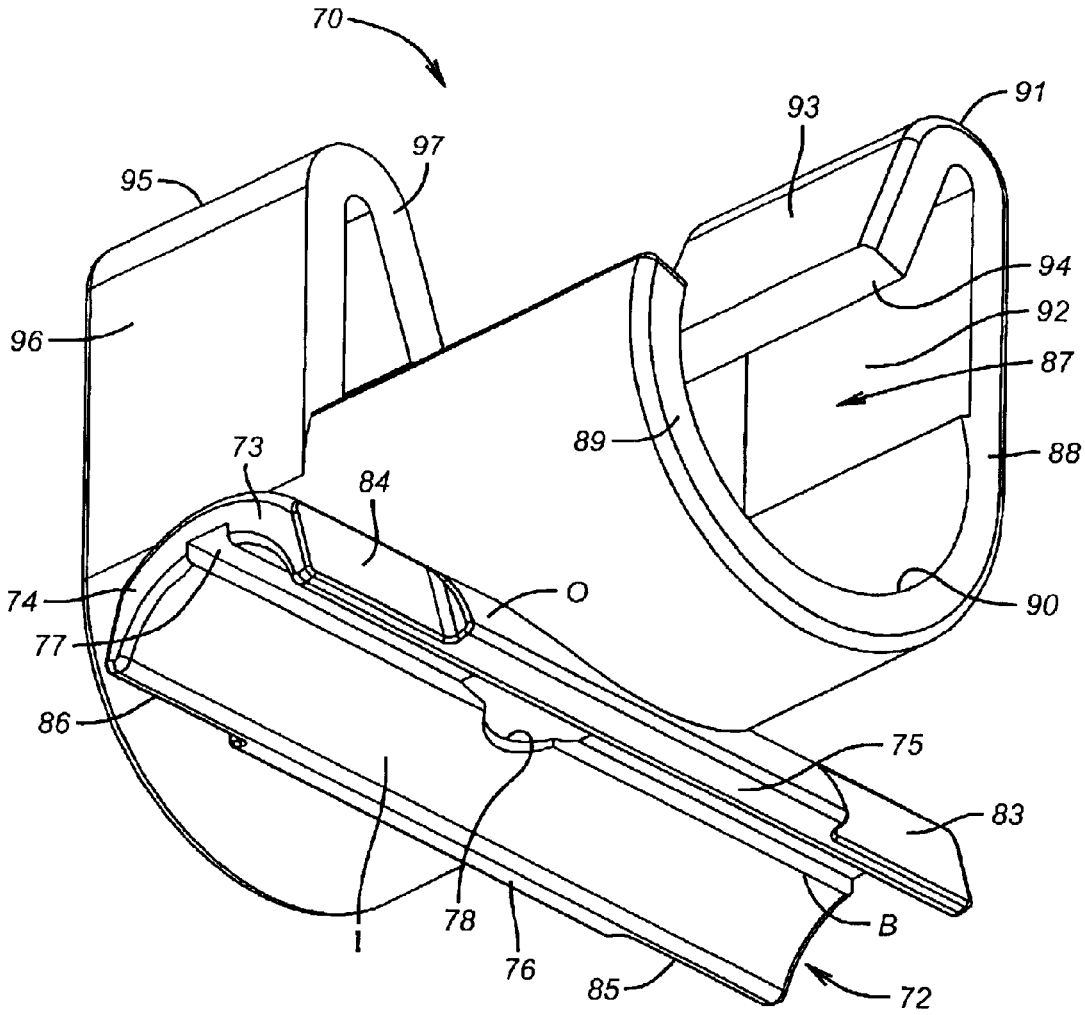
FIG. 8 is a perspective view from below of the saddle clip embodiment of this invention shown in FIG. 2.

FIG. 8 provides perhaps the best view of saddle structures. Referring to FIG. 8, saddle 72 is generally semicircular in cross section with an outer surface "O" and an inner surface "I", opposing sides 73, 74, linear edges 75, 76 along sides 73, 75, and a basal portion "B" intermediate edges 75, 76. Cradle 32 and saddles 72 each have at least one facility for providing structure complementary to the surface configuration of transverse bar 20, for the purpose of obstructing rotation of body 30, 70, respectively, about the axis of transverse bar 20 when transverse bar 20 is conformingly received in cradle 32 or saddle 72. Referring to saddle 72 in FIG. 8, a depression 77 in the form of a channel extends the length of the inside I of the saddle. Channel 77 widens intermediate its ends to form a portion 78 extending transversely to the axial direction of channel 77. In the embodiments shown in FIG. 14, saddle 72 differs in having a plurality of raised structures on inner surface "I". The raised structures are a pair of spaced nibs 79, 80 and 81, 82 adjacent edges 75 and 76 respectively. In the chair shown in FIG. 13, the cradle 32 differs in having nibs 40, 42.

Figure 10:
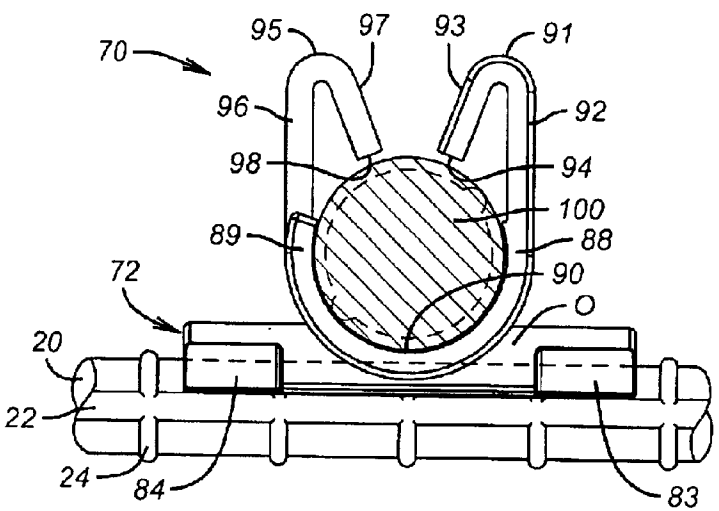
FIG. 10 is a end view of the saddle clip of FIG. 8.
Figure 9:
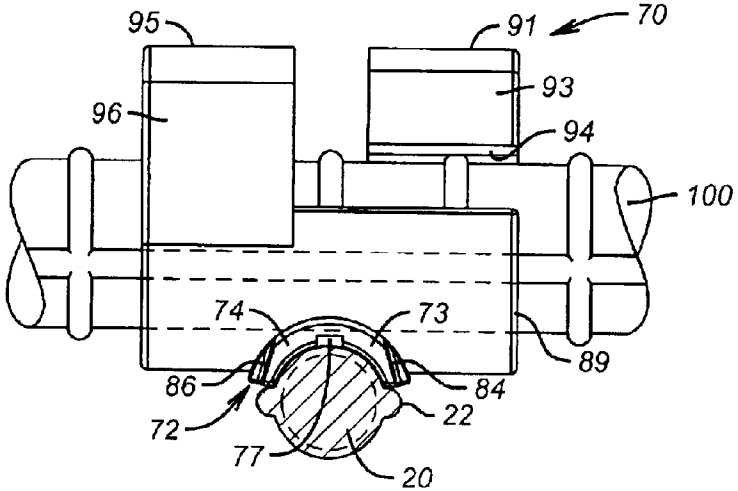
FIG. 9 is a side view of the saddle clip of FIG. 8.
Figure 11:
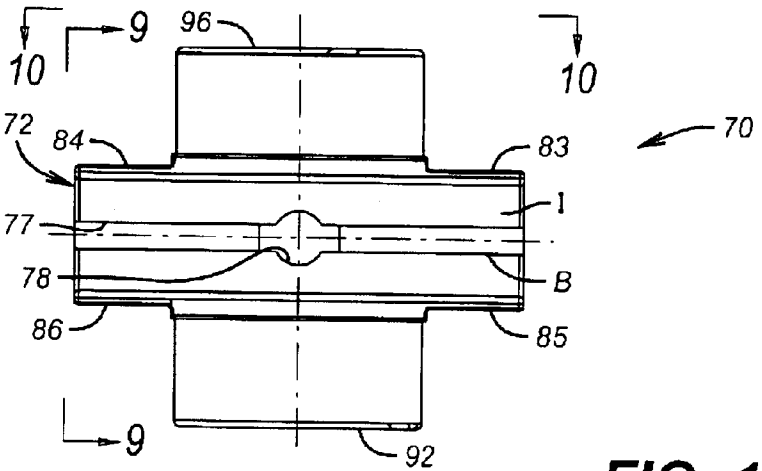
FIG. 11 is a bottom plan view of saddle clip of FIG. 8.

Referring to FIGS. 9 and 10 especially, saddle 72 straddles and rides on transverse bar 20, and is shaped and sized such that edges 75, 76 confront diametrically opposed longitudinal ribs 22 of transverse bar 20 to center basal portion "B" of saddle 72 on transverse bar 20 when longitudinal ribs 22 of transverse bar 20 are horizontal. Thus edges 75, 76 of saddle 72 preferably contact longitudinal rib 22 of transverse bar.

Referring to FIGS. 4-7 and 13, transverse bar bed cradle 32 is essentially an inverted saddle 72. Cradle 72 receives and cradles transverse bar 20 from above, and sides 33, 34 of cradle 32 extend upwardly from basal portion "B" of cradle 32 for receiving, within sides 33, 34, the lower portion of transverse bar 20. This aids in centering transverse bar 20 in the cradle of cradle 32 with longitudinal ribs 22 at horizontal. Thus longitudinal ribs 22 of transverse bar 20 preferably contact edges 35, 36 of cradle 32. By assuring that cradle 32 accepts transverse bar 20 in a disposition with longitudinal ribs 22 at horizontal, both cradle 32 and saddle 72 are properly mounted on transverse bar 20 so that crook staffs 91, 95 are vertically mounted on transverse bar 20.

As described above, a bonding agent, suitably an adhesive, is applied to the inner side of cradle 32 and saddle 72 before placement of transverse bar 20 on cradle 32 and saddle 72 on transverse bar 20, at a minimum to provide an anti-rotation property making use of the depression and/or raised structure facilities on the inner surface "I" of cradle 32 and saddle 72 if the bonding agent does not bond the plastic to the transverse bar or the epoxy coating covering the transverse bar.

The outer surfaces of cradle 32 and saddle 72 include flats (83, 84, 85 and 86 on saddle 72; 43, 44, 45 and 46 on cradle 32), which shortening the perimeter around saddles 32 and 72 to afford a tighter binding for a tie (suitably cable clamp) wrap that may be extended around outer surface "O" over transverse bar 20 received in cradle 32 and saddle 72. The tie aids in binding cradle 32 and saddle 72 to transverse bar 20 during setup and cure of the bonding agent, and may be left in place as an additional aid to immobilization of transfer bar 20 in cradle 32, saddle 72.

Each of chair 30 and saddle clip 70 incorporates at least one upwardly open horizontal seat; in chair 30, it is seat 47 and in saddle clip 70, it is seat 87. Seats 47, 87 having opposing sides (48, 49 for seat 47; 88, 89 for seat 87) and a floor (50 for seat 47; 90 for seat 87) at an elevation above the bed (bed 32 for seat 47, bed 72 for seat 87) respectively orthogonal to the bed 32, 72 for accepting an elongate longitudinal rod 100 over and across transverse bar 20 received in bed 32, 72 (see FIGS. 9 and 10 especially).

Referring first to FIGS. 8-11 and 14, a crook staff 91 on one side 88 of seat 87 has a vertical staff or shank portion 92 and a downwardly inwardly extending portion 93 projecting toward seat 87 ending in a tip 94 spaced above floor 90 of seat 87 a distance at least as wide as the diameter of longitudinal rod 100 which scat 87 accommodates. A second crook staff 95 on side 89 of seat 87 has a vertical portion 96 and a downwardly inwardly extending portion 97 projecting toward seat 87 ending in a tip 98 also spaced above floor 90 of seat 87 a distance at least as wide as the diameter of longitudinal rod 100 which seat 87 accommodates. Crook staffs 91, 95 are arranged along sides 88, 89 of seat 87 not to oppose one another, but may have an arrangement as in the crook staffs 51, 55 of chair 30, such that crook staffs 91, 95 are arranged along sides 88, 89 of seat 87 to oppose one another.

The crook portions 93, 97 of crook staffs 91 and 95 deflect away from each other toward their respective staff portions 92, 96 to allow a longitudinal rod 100 to pass between deflected crook portions 93, 97 into seat 87, then spring back to an undeflected position after placement of longitudinal rod 100 in seat 87 such that, with longitudinal rod 100 in seat 87, solely tips 94, 98 of crook portions 93, 97 respectively are positioned to contact longitudinal rod 100 when an external force is exerted on body 70 or longitudinal rod 100 tending to rotate one of them relative to the other about the axis of transverse bar 20. This arrangement allows the external force to be resisted. The manner of operation of this juxtaposition of crook staffs is explained above. Briefly, upon occurrence of the external force, interaction between crook staffs 91, 95 and longitudinal rod 100 contacting at tips 94, 98 resists the external force effectively to retain longitudinal rod 100 in seat 87 and combine with channels 77, 78 and nibs 79, 80, 81 and 82 of clip body 70 to forestall rotation of one of rod 100 or body 70 about the axis of transverse bar 100.

Referring now to FIGS. 4-7 and 13, chair body 30 includes a support extending from chair body 30 for spacing chair body 30 above a surface to receive a pour of concrete (see FIG. 12). Such support comprises a pair of legs 59, 60 spreadingly extending from cradle 32 transversely to the direction of transverse bar 20 received in cradle 32. A base 61 interconnects ends 62, 63 of legs 59, 60, and center post 64 provides supplemental vertical support. In the embodiment of FIGS. 4-7 and 13, certain elements of chair 30 corresponding to similar elements of saddle clip 30 are in effect bifurcated by provision of an opening between them leaving room for transverse bar 20 to be lowered onto cradle 32. This "bifurcation" is signified by use of suffix letter "A" for element members on one side of the opening that allows placement of transverse bar 20 on cradle 32, and the use of the suffix letter "B" for element members on the other side of that opening. Thus, seat 47 comprises a plurality of seats 47A, 47B in horizontal alignment spaced separated above cradle 32. Only crook staffs 51B, 55A may be disposed on chair 30, as are the crook stalls 81, 85 on saddle clip 70, that is, alongside at least one side of each of separated seats 47A and 47B, but preferably, and as shown in FIGS. 4-7 and 13, crook staffs 51A, 51B are alongside sides 48A, 48B and crook staffs 55A, 55B are alongside sides 49A, 49B of each of seats 47A, 47B. Crook staffs 51A, 51B and 55A, 55B extend as a continuation of portions adjacent the sides 48A, 48B and 49A, 49B, respectively, which in turn are formed in risers 66A, 66B and 65A, 65B from upper portions 67, 68 of legs 59, 60 spanning cradle 32. Crook staffs 51A, 51B on side 48A, 48B of separated seats 47A and 47B have vertical portions 52A, 52B and downwardly inwardly extending crook portions 53A, 53B projecting toward seats 47A, 47B ending in tips 54A, 54B spaced above floors 50A, 50B of seats 47A, 47B a distance at least as wide as the diameter of longitudinal rod 100 which seat 47 accommodates. Second crook staffs 55A, 55B on sides 49A, 49B of seats 47A, 47B have vertical portions 56A, 56B and downwardly inwardly extending crook portions 57A, 57B projecting toward seats 47A, 47B ending in tips 58A, 58B also spaced above floor 50A, 50B of seats 47A, 47B a distance at least as wide as the diameter of longitudinal rod 100 which seats 47A, 47B accommodates. Crook portions 53A, 53B of staffs 51A, 51B and crook portions 57A, 57B of crook staffs 55A, 55B deflect away from each other and toward respectively vertical staff portions 52A, 52B of crook staffs 51A, 51B and vertical staff portions 56A, 56B of crook staffs 55A, 55B above seats 47A, 47B to allow longitudinal rod 100 to pass between the deflected crook portions 53A, 53B of staffs 51A, 51B and crook portions 57A, 57B of crook staffs 55A, 55B into seats 47A, 47B and spring back to an undeflected position after placement of longitudinal rod 100 in seats 47A, 47B, such that, with longitudinal rod 100 in seats 47A, 47B, solely tips 54A, 54B and 58A, 58B of crook staffs 51A, 51B and 55A, 55B respectively are positioned to contact longitudinal rod 100 when external force is exerted on body 30 or longitudinal rod 100 tending to rotate one of them relative to the other about the axis of transverse bar 20. This arrangement allows the external force to be resisted as explained above.

Preferably chair 30 and saddle clip 60 are made of a durable non-metallic material. A preferred material is a thermoplastic material that can be suitably molded to the desired configuration and have the requisite strength and toughness for use in this application, such as nylon or polypropylene. Paving sites can be very hot in the heat of the summer and cold in winter months. The plastic should be chosen to give a heat deformation point at a suitably high temperature for the temperatures the plastic may be expected to reach at a job site, for example about 180–210° F. in the desert southwest of the U.S., but should not be so brittle as to crack or break when force is applied to press longitudinal rebar into the longitudinal rebar seat of the chair 30 or saddle clip 60.

Chair 30 and saddle clip 70 comprise a system of pieces for assembly onto a transverse bar 20. A method of assembling a transverse bar assembly 10 for reinforcement of a pour of concrete for paving comprises bonding to transverse bar 20 a plurality of chair bodies 30 and saddle clip bodies 70. A transverse bar assembly 20 is seen in FIG. 1 and is to be arranged in a direction transverse to the length of a roadway base onto which concrete is to be poured. Referring to FIG. 12, a reinforcing mat 150 for a pour of concrete in construction of a continuously reinforced concrete paving comprises a plurality of transverse bar assemblies 10 including transverse bar 20, a plurality of chair pieces 30 and saddle clips 70, with each assembly 10 arranged 11 a direction transverse to the length of a concrete paving to be poured, plus a plurality of longitudinal bars 100 received longitudinally within the chair body seats 47 (47A, 47B in the embodiment of FIGS. 4-7 and 13) and clip body seats 87 of each of transverse bar assemblies 10.

A method of constructing a continuously reinforced concrete paving comprises constructing on the base of a roadbed to receive a pour of concrete a reinforcing mat 150 constructed with the apparatus of this invention and poring concrete onto the roadbed and embedding reinforcing mat 150 in the concrete.

As may be appreciated from the foregoing description, and as shown ill FIG. 12, a plurality of longitudinal bars 100 locked in the seats 47A, 47B and 87, respectively, by crook staffs 51A, SIB and 55A, 55B of chair piece 30 of the embodiment of FIGS. 4-7 and 13 and crook staffs 91, 95 of clip body 70, for a plurality of chair pieces 30 and a plurality of clip pieces 70, with each support piece 30 and each clip piece 70 able to resist any force that would tend to rotate a longitudinal bar around the axis of transverse bar 20 and each longitudinal bar able to resist any force that would tend to rotate transverse bar 20 about its axis, provides a structure in which the strength of the entire reinforcing mat is concerted to resist the concrete paving forces that cause walking, racking and rotation of TBA's of the prior art.

Referring now to FIGS. 15-18, a variation of the embodiments of Figs refinement of the embodiments of 4-7 is shown. Where structure is unchanged from the embodiment of FIGS. 4-7, the same reference numerals are used. The variation shown in FIGS. 15-18 provides curvilinear ribs in sides of the seats 47 from which crook staffs 5.1, 55 extend. One or more ribs may be provided for each seat side extending upwardly to each crook staff. In FIGS. 15-18, double ribs are shown. For seat side 49A, ribs 102, 103 are shown. For seat side 49B, ribs 104, 105 are shown. For seat side 48A, ribs 106, 107 are shown. For seat side 48B, ribs 108, 109 are shown. As curvilinear ribs, they are curved from one end to the other. In the embodiment, the maximum projections of the ribs are adjacent the sides of the seat 47. Thus the maximum projection of ribs 102, 103 is adjacent seat 49A, the maximum projection of ribs 104, 105 is adjacent seat 49B, the maximum projection of ribs 106, 107 is adjacent seat 48A, and the maximum projection of ribs 108, 109 is adjacent seat 48B. A lower portion of the ribs extends below sides 48A, 48B and 49A, 49B, respectively into risers 66A, 66B and 65A, 65B from upper portions 67, 68 of legs 59, 60 spanning cradle 47. The ribs assure that the staffs 51, 55 do not bend outwardly under moments of force seeking to unseat longitudinal rod 100. Ribs may also be similarly formed into the staffs of crook shafts 91, 95 of the saddle clip pieces 70. Since the sides of the seats 87 of saddle clips 70 have similar structure, it is not necessary to describe the ribs for them.

Figure 19:
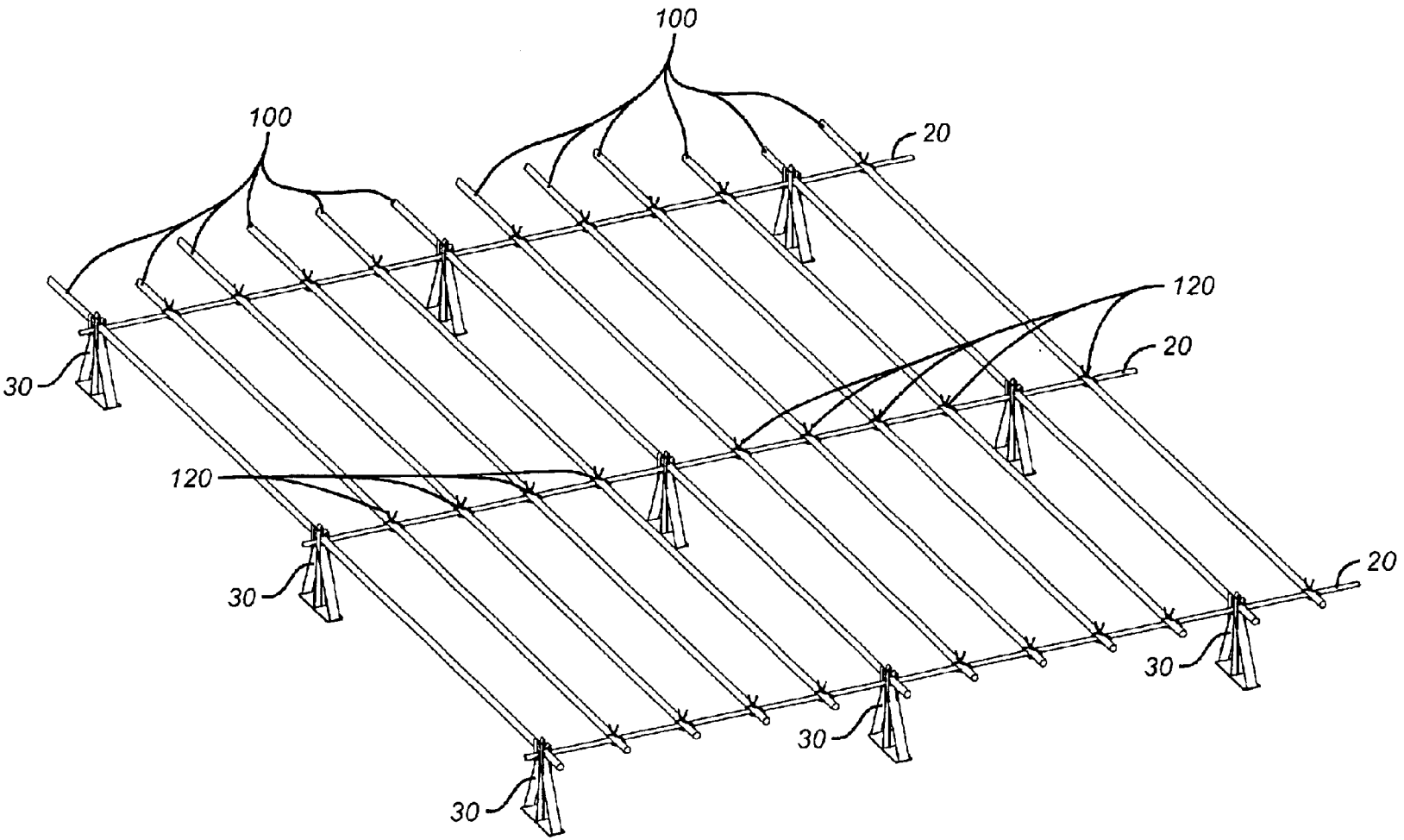
FIG. 19 is a perspective of a novel rebar mat portion comprising the chairs of this invention but not the saddle clips.

As mentioned above, chair 30 may be used to assemble a rebar mat without the use of saddle clips 70. Such a rebar mat is shown in FIG. 19. A transverse rebar rod 20 is laid out on the ground at the specified intervals. Each transverse rebar rod 20 is then placed in cradles 32 of a plurality of chairs 30 and secured by ties. Longitudinal rebar rods 100 are then forced between staff crooks 51, 55 to spread them and allow the longitudinal rebar rods 100 to be seated in seats 47, retained in place by staff crooks 51, 55. Other longitudinal rebar rods 100 are then laid out on top of the transverse bars 20 between chairs 30 and these longitudinal rebars 100 are wire tied, as representatively shown at 120 in FIG. 19, to each transverse rebar 20 to form a mat.

Another variation of the embodiments of described above is shown in FIGS. 20-28. These variations show the use of a tubing bed as opposed to a semicircular bed for the transverse rebar. Where structure is unchanged from the foregoing figures, the same reference numerals are used.

Figure 21:
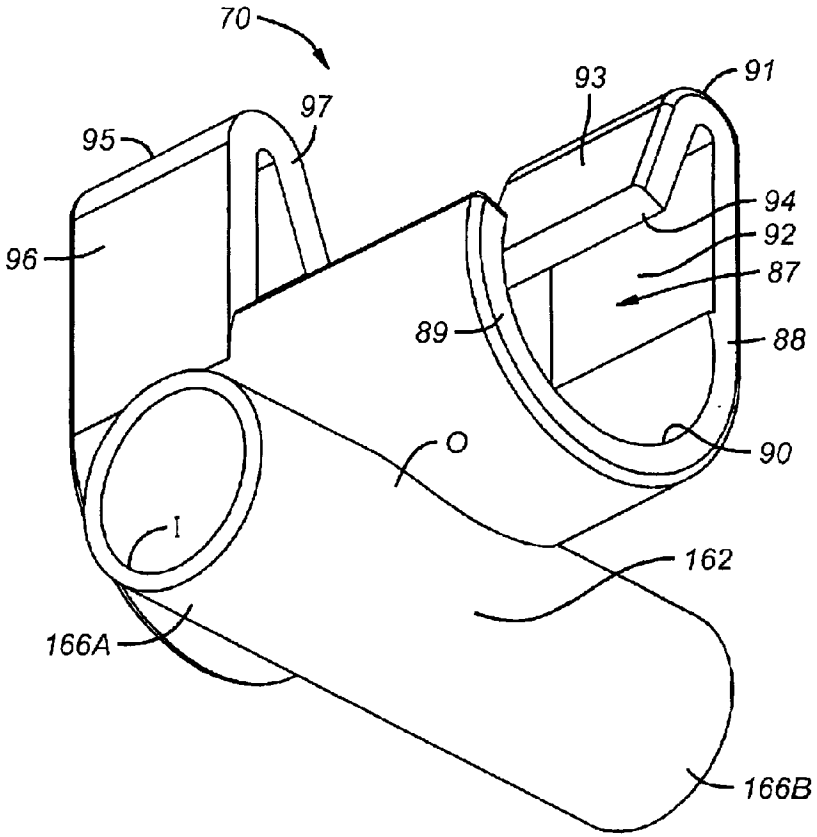
FIG. 21 is a perspective view in the same orientation as FIG. 8 showing the variant embodiment of a saddle clip of this invention in which the transverse bar bed is tubular.
Figure 20:
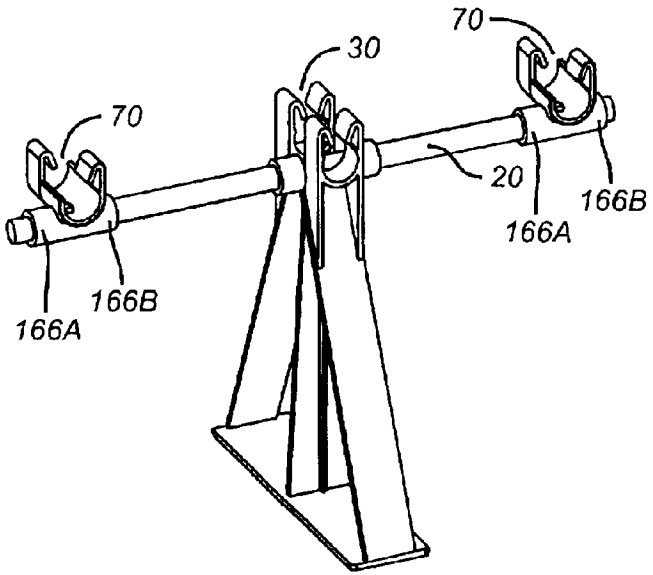
FIG. 20 is a perspective view of embodiments of the chair invention and the saddle clip invention in which the transverse bar bed is tubular.
Figure 26:
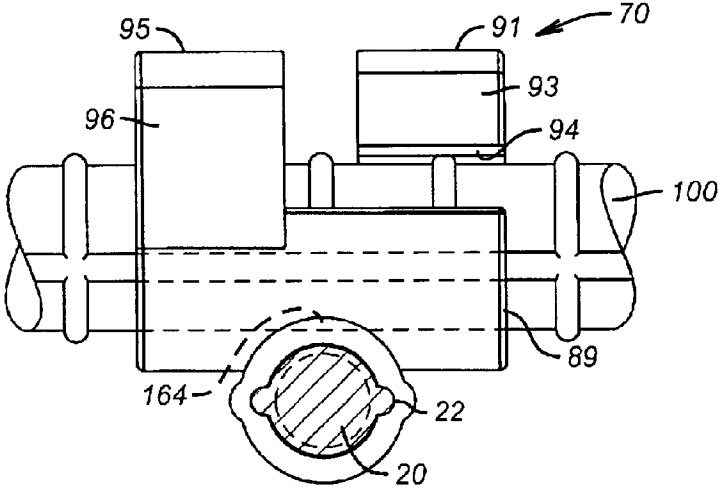
FIG. 26 is a side view of the saddle clip of FIG. 21.
Figure 28:
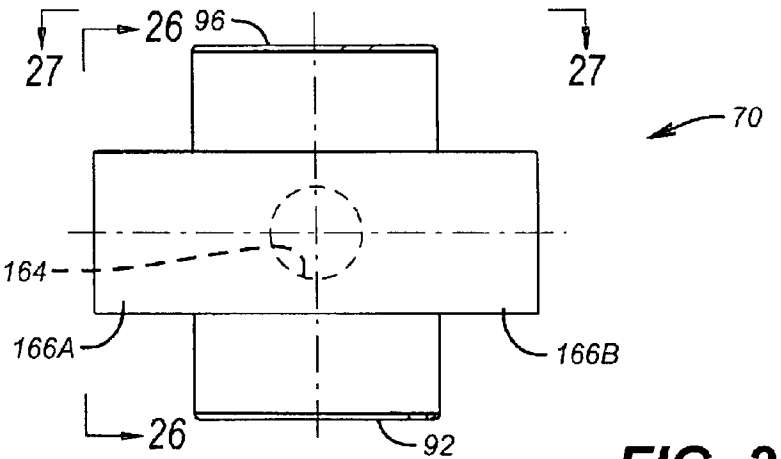
FIG. 28 is a bottom plan view of saddle clip of FIG. 21.

Referring to FIG. 21, bed 162 of clip 70 is generally tubular with an outer surface "O" and an inner surface "I". Tubular bed 162 has an upper vacation area indicated at 164 of size to permit a transverse bar 20 resting in bed 162 and a longitudinal bar seated in seat 87 to directly contact each other at the area of vacation 164 to resist forces which if unresisted would move clip 70. Bed 162 is thermoplastic. Longitudinally distal portions 166A and 166B of bed 162 are thermally deformable around a longitudinal bar 100 axially received in bed 162. The thermal deformation, suitably with heated claims pressing on portions 166A and 166B, permit portions 166A and 166B to acquire a configuration matingly complementary to the surface configuration of longitudinal bar 100, as indicated in FIG. 26.

Figure 22:
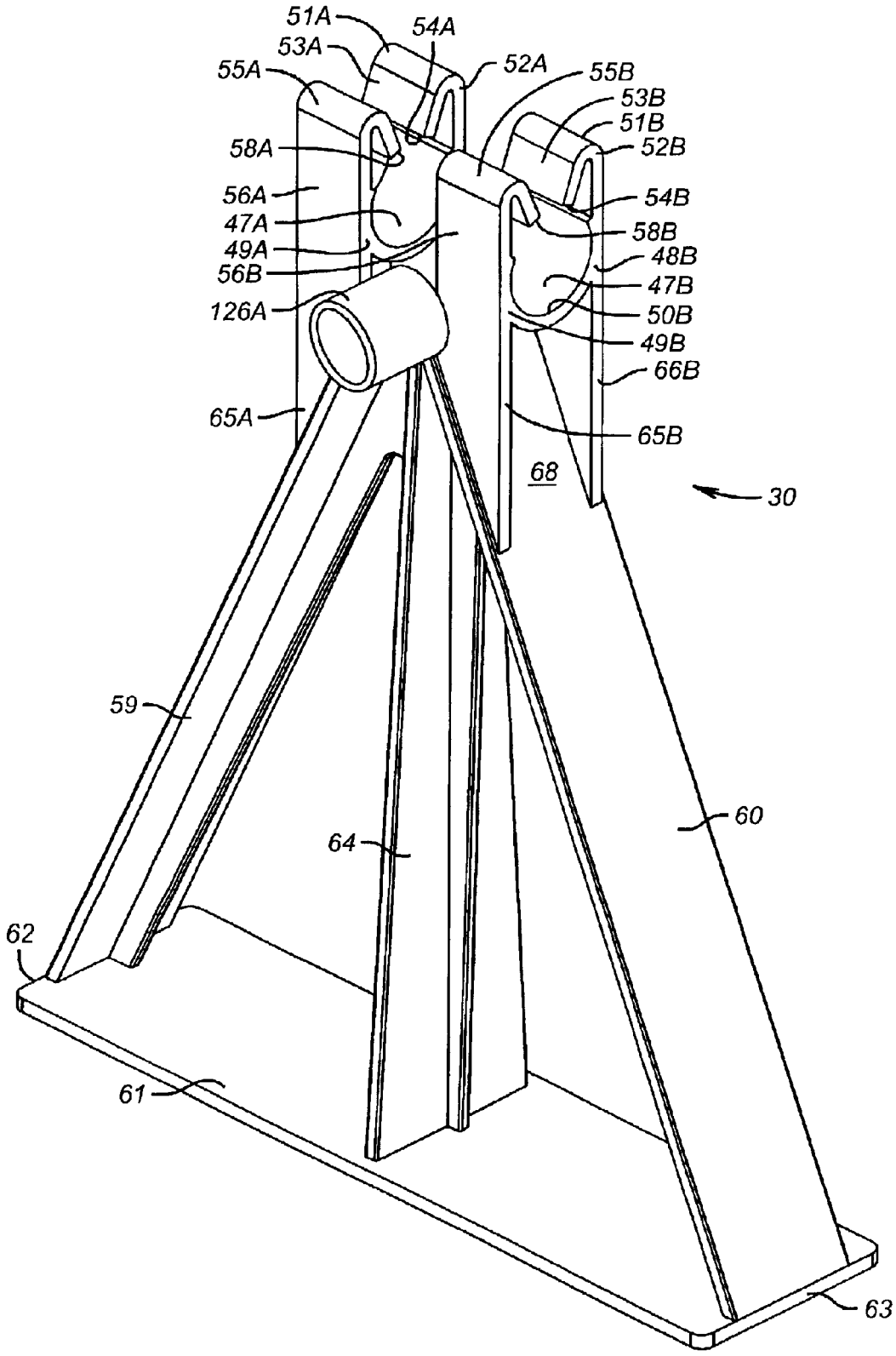
FIG. 22 is a perspective view in the same orientation as FIGS. 4 and 15 showing the variant embodiment of a chair of this invention in which the transverse bar bed is tubular.
Figure 25:
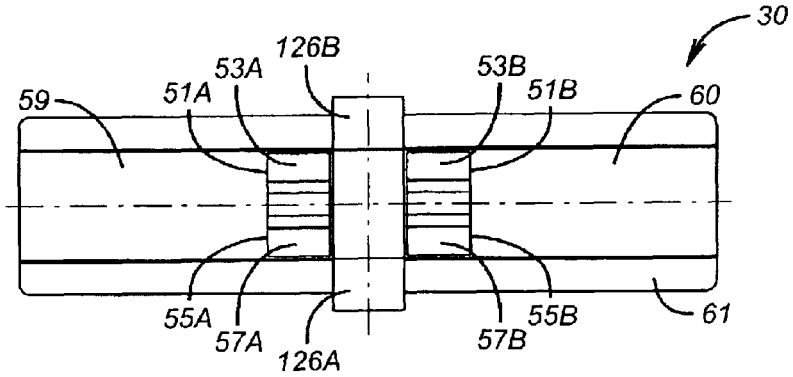
FIG. 25 is a top plan view of the chair of FIG. 22.
Figure 23:
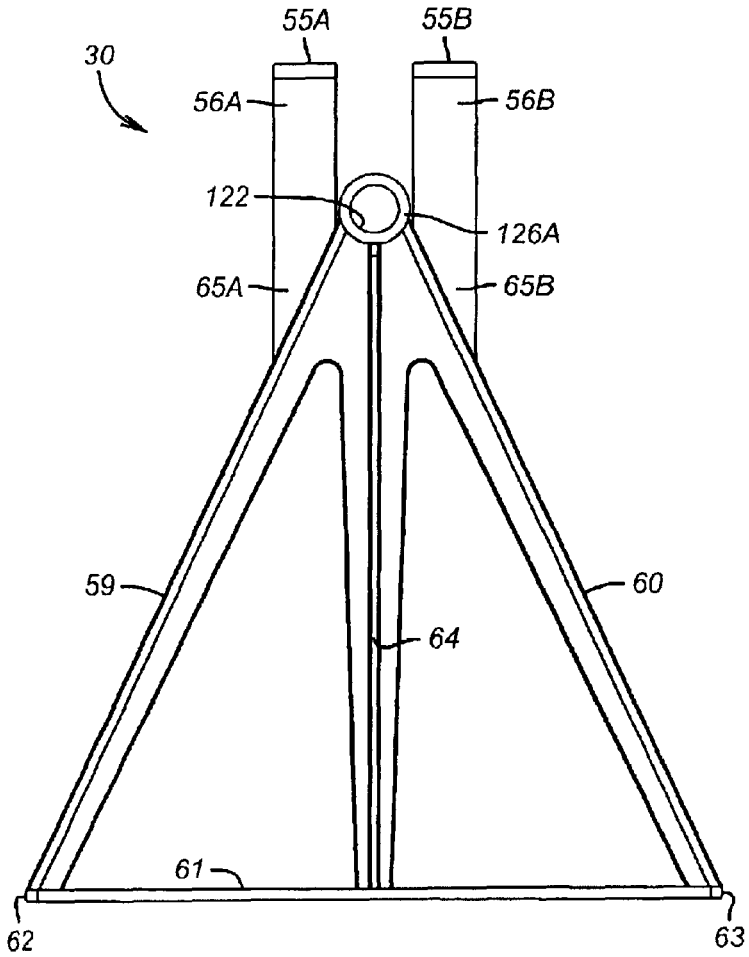
FIG. 23 is an end view of the chair of FIG. 22.
Figure 24:
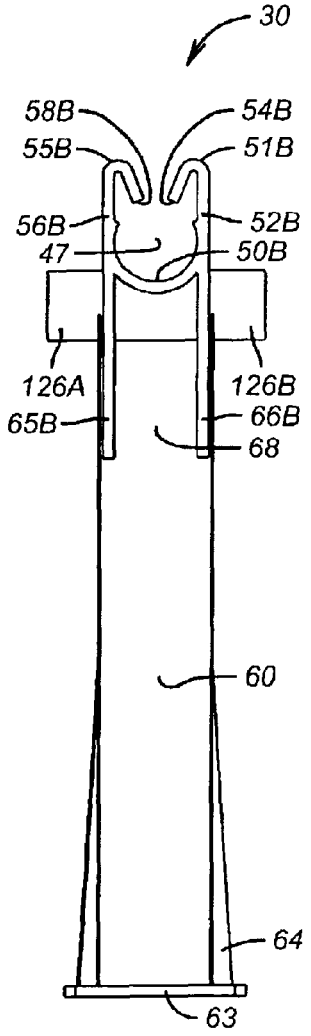
FIG. 24 is a side view of the chair of FIG. 22.
Figure 27:
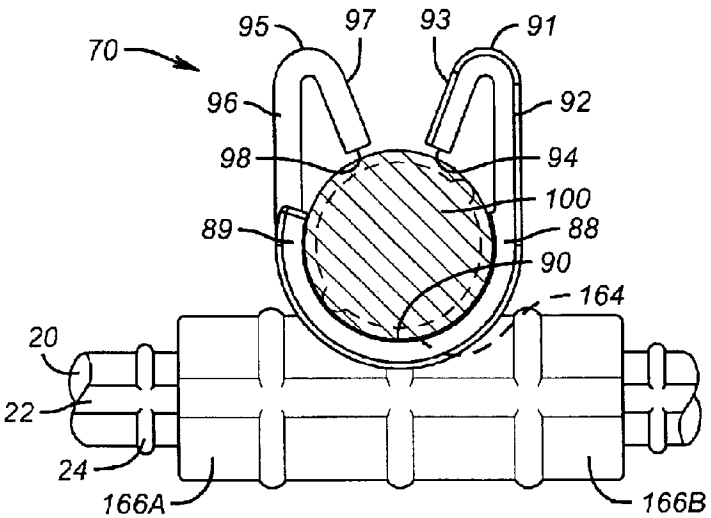
FIG. 27 is a end view of the saddle clip of FIG. 21.

Referring to FIGS. 22-24, bed 122 of chair 30 is generally tubular and comprises two coaxial tubular segments 126A and 126B spaced apart a distance sufficient to permit a transverse bar 20 resting in bed 122 and a longitudinal bar 100 seated in seat 47 to directly contact each other to resist forces which if unresisted would move chair 3'). Bed 162 is thermoplastic. Longitudinally distal portions 126A and 126B of bed 122 are thermally deformable around a longitudinal bar 100 axially received in tubular segments 126A and 126B. The thermal deformation, suitably with heated claims pressing on portions 126A and 126B, permit portions 126A and 126B to acquire a configuration matingly complementary to the surface configuration of longitudinal bar 100.

Having described specific embodiments of our invention, we do not mean to limit our invention only to the embodiments described and depicted. Our invention is as particularly pointed out in the following claims.

What is claimed is:

1. Apparatus for use in holding rebar, comprising a body including:

(a) a horizontal bed having an axis oriented in a first axial direction and sides to receive a transverse rebar rod in said first axial direction, (b) at least one upwardly open horizontal seat having an axis stationarily oriented in a second axial direction orthogonal to said first axial direction, said seat having opposing sides and being positioned above said bed sufficiently to permit a longitudinal rebar rod to sit in said seat such that said longitudinal rebar rod is located immediately above said transverse rebar rod and oriented in said second axial direction, and (c) at least one crook staff on one side of said at least one seat and at least one crook staff on a side of a said seat opposite said one side, staff portions of said crook staff each extending above said seat to transition to crook portions of the crook staffs, said crook portions extending downwardly toward a said seat, said downwardly extending crook portions being spaced from said staff portions, said downwardly extending crook portions being resiliently deformable toward said staff portions to vertically pass between them to be seated in a said seat a downwardly forced longitudinal rebar rod extending in the direction of said axis of a said seat, said downwardly extending crook portions of said crook staffs returning resiliently to an undeformed position after passage of said longitudinal rebar rod therebetween, said crook portions compressively and said staff portions tensilely resisting movement of a seated said longitudinal rebar rod out of a said seat.

2. The apparatus of claim 1 in which said staff portions of said crook staffs include vertical ribbing to stiffen said staff portions against bending.

3. The apparatus of claim 2 in which said ribbing is curvilinear with a maximum curvilinear projection at an elevation where a maximum bending moment would be expressed.

4. The apparatus of claim 3 in which the maximum projection is adjacent said sides of said seats.

5. The apparatus of claim 1 comprising a plurality of said seats and in which said crook staffs are arranged along said sides of said seats not to oppose one another.

6. The apparatus of claim 1 in which said crook staffs are arranged along said sides of said at least one seat to oppose one another.

7. The apparatus of claim 6 comprising a plurality of said seats each with opposing crook staffs.

8. The apparatus of claim 1 in which said body includes a support extending downwardly from said body for spacing said body above a base.

9. The apparatus of claim 8 in which said bed is substantially semicircular, opening upwardly.

10. The apparatus of claim 9 in which said bed further includes tie surfaces exteriorly of said bed for tying said transverse rebar rod to said bed.

11. The apparatus of claim 9 in which said bed includes surface configurations for cooperation with a bonding agent for fixing a transverse rebar rod received therein against movement in said bed.

12. The apparatus of claim 9 in which said transverse rebar rod has a defined surface configuration and said bed has at least one facility for providing structure complementary to said surface configuration of said transverse rebar rod for preventing movement of said body relative to said transverse rebar rod.

13. The apparatus of claim 8 in which said bed is tubular.

14. The apparatus of claim 13 in which said tubular bed comprises two coaxial tubular segments spaced apart a distance sufficient to permit a transverse rebar rod resting in said bed and a longitudinal rebar rod sitting in said seat to directly contact each other to resist forces which if unresisted would move said body.

15. The apparatus of claim 14 in which said segments are thermoplastic and thermally deformable around a transverse rebar rod axially received in said segments to acquire a configuration matingly complementary to the surface configuration of said transverse rebar rod.

16. The apparatus of claim 8 in which said staff portions of said crook staffs include vertical ribbing to stiffen said staff portions against bending.

17. The apparatus of claim 16 in which said ribbing is curvilinear with a maximum curvilinear projection at an elevation where a maximum bending moment would be expressed.

18. The apparatus of claim 17 in which the maximum projection is adjacent said sides of said seats.

19. The apparatus of claim 1 in which said bed is a substantially semicircular saddle for sitting on said transverse rebar rod.

20. The apparatus of claim 19 in which said bed further includes tie surfaces exteriorly of said bed for tying said bed to said transverse rebar rod.

21. The apparatus of claim 19 in which said bed includes surface configurations for cooperation with a bonding agent for fixing a transverse rebar rod received therein against movement in said bed.

22. The apparatus of claim 19 in which said transverse rebar rod has a defined surface configuration and said bed has at least one facility for providing structure complementary to said surface configuration of said transverse rebar rod for preventing movement of said body relative to said transverse rebar rod.

23. The apparatus of claim 1 in which said bed is tubular.

24. The apparatus of claim 23 in which said tubular bed comprises an upper vacation of size to permit a transverse rebar rod resting in said bed and a longitudinal rebar rod sitting in said seat to directly contact each other to resist forces which if unresisted would move said body.

25. The apparatus of claim 24 in which said bed is thermoplastic and longitudinally distal portions of said bed are thermally deformable around a transverse rebar rod axially received in said bed to acquire a configuration mating complementary to the surface configuration of said transverse rebar rod.

26. A transverse bar assembly, comprising:

(a) a transverse rebar rod, (b) a plurality of first bodies each including a support extending downwardly for spacing said body above a base, each said body further including:

(1) a horizontal bed having an axis oriented in a first axial direction and sides receiving said transverse rebar rod in said first axial direction, (2) a plurality of upwardly open horizontal seats having an axis stationarily oriented in a second axial direction orthogonal to said first axial direction, said seats having opposing sides and being positioned above said bed sufficiently to permit a longitudinal rebar rod to sit in said seats such that said longitudinal rebar rod is located immediately above said transverse rebar rod and oriented in said second axial direction, and (3) at least one crook staff on one side of said seats and at least one crook staff on the opposite side of said seats, staff portions of such opposing crook staffs each extending above said seats to transition to crook portions of such crook staffs, said crook portions extending downwardly toward said seats said downwardly extending crook portions being spaced from said staff portions, said downwardly extending opposing crook portions being resiliently deformable toward their corresponding staff portions to vertically pass between such opposing crook portions for seating in said seats a downwardly forced longitudinal rebar rod extending in the direction of said axis of said seats, said downwardly extending crook portions of said opposing crook staffs returning resiliently to an undeformed position after passage of said longitudinal rebar rod therebetween, said crook portions compressively and said staff portions tensilely resisting movement out of a said seat of a seated said longitudinal rebar rod, and (c) a plurality of second bodies intermediate pairs of said first bodies, said second bodies having a horizontal bed with an axis oriented in said first axial direction and sides receiving and clasping said transverse rebar rod in said first axial, said second bodies each having:

(1) at least one upwardly open horizontal seat having an axis stationarily oriented in a second axial direction orthogonal to said first axial direction, said seat having opposing sides and being positioned above said bed sufficiently to permit a longitudinal rebar rod to sit in said seat such that said longitudinal rebar rod is located immediately above said transverse rebar rod and oriented in said second axial direction, and (2) at least one crook staff on one side of said at least one seat and at least one crook staff on a side of a said seat opposite said one side, staff portions of said crook staffs each extending above said seat to transition to crook portions of the crook staffs, said crook portion extending downwardly toward a said seat said downwardly extending crook portions being spaced from said staff portions, said downwardly extending crook portions being resiliently deformable toward said staff portions to vertically pass between them to be seated in a said seat a downwardly forced longitudinal rebar rod extending in the direction of said axis of a said seat, said downwardly extending crook portions of said crook staffs returning resiliently to an undeformed position after passage of said longitudinal rebar rod therebetween, said crook portions compressively and said staff portions tensilely resisting movement of a seated said longitudinal rebar rod out of a said seat.

27. The apparatus of claim 26 in which said staff portions of said crook staffs include vertical ribbing to stiffen said staff portions against bending.

28. The apparatus of claim 27 in which said ribbing is curvilinear with a maximum curvilinear projection at an elevation where a maximum bending moment would be expressed.

29. The apparatus of claim 28 in which the maximum projection is adjacent said sides of said seats.

30. A rebar mat comprising (a) a plurality of transverse rebar rods, (b) a plurality of chairs for each said transverse rebar rod, each chair comprising:

(1) a body, (2) a support extending downwardly for spacing said body above a base, each said body further including:

(A) a horizontal bed having an axis oriented in a first axial direction and sides receiving a said transverse rebar rod in said first axial direction, (B) a plurality of upwardly open horizontal seats having an axis stationarily oriented in a second axial direction orthogonal to said first axial direction, said seats having opposing sides and being positioned above said bed sufficiently to permit a longitudinal rebar rod to sit in said seats such that said longitudinal rebar rod is located immediately above said transverse rebar rod and oriented in said second axial direction, and (C) at least one crook staff on one side of said seats and at least one crook staff on the opposite side of said seats, staff portions of such opposing crook staffs each extending above said seats to transition to crook portions of such crook staffs, said crook portions extending downwardly toward said seats, said downwardly extending crook portions being spaced from said staff portions, said downwardly extending opposing crook portions being resiliently deformable toward their corresponding staff portions to vertically pass between such opposing crook portions for seating in said seats a downwardly forced longitudinal rebar rod extending in the direction of said axis of said seats, said downwardly extending crook portions of said opposing crook staffs returning resiliently to an undeformed position after passage of said longitudinal rebar rod therebetween, said crook portions compressively and said staff portions tensilely resisting movement out of a said seat of a seated said longitudinal rebar rod, and (c) a plurality of longitudinal rebar rods received in said seats of said chairs.

31. The apparatus of claim 30 in which said staff portions of said crook staffs include vertical ribbing to stiffen said staff portions against bending.

32. The apparatus of claim 31 in which said ribbing is curvilinear with a maximum curvilinear projection at an elevation where a maximum bending moment would be expressed.

33. The apparatus of claim 32 in which the maximum projection is adjacent said sides of said seats.

34. A rebar mat comprising (a) a plurality of transverse rebar assemblies, each transverse bar assembly comprising:

(1) a transverse rebar rod, (2) a plurality of first bodies each including a support extending downwardly for spacing said body above a base, each said body further including:

(A) a horizontal bed having an axis oriented in a first axial direction and sides receiving said transverse rebar rod in said first axial direction, (B) a plurality of upwardly open horizontal seats having an axis stationarily oriented in a second axial direction orthogonal to said first axial direction, said seats having opposing sides and being positioned above said bed sufficiently to permit a longitudinal rebar rod to sit in said seats such that said longitudinal rebar rod is located immediately above said transverse rebar rod and oriented in said second axial direction, and (C) at least one crook staff on one side of said seats and at least one crook staff on the opposite side of said seats, staff portions of such opposing crook staffs each extending above said seats to transition to crook portions of such crook staffs, said crook portions extending downwardly toward said seat said downwardly extending crook portions being spaced from said staff portions, said downwardly extending opposing crook portions being resiliently deformable toward their corresponding staff portions to vertically pass between such opposing crook portions for seating in said seats a downwardly forced longitudinal rebar rod extending in the direction of said axis of said seats, said downwardly extending crook portions of said opposing crook staffs returning resiliently to an undeformed position after passage of said longitudinal rebar rod therebetween, said crook portions compressively and said portions tensilely resisting movement out of a said seat of a seated said longitudinal rebar rod, and (3) a plurality of second bodies intermediate pairs of said first bodies, said second bodies having a horizontal bed with an axis oriented in said first axial direction and sides receiving and clasping said transverse rebar rod in said first axial direction, said second bodies each having:

(A) at least one upwardly open horizontal seat having an axis stationarily oriented in a second axial direction orthogonal to said first axial direction, said seat having opposing sides and being positioned above said bed sufficiently to permit a longitudinal rebar rod to sit in said seat such that said longitudinal rebar rod is located immediately above said transverse rebar rod and oriented in said second axial direction, and (B) at least one crook staff on one side of said at least one seat and at least one crook staff on a side of a said seat opposite said one side, staff portions of said crook staffs each extending above said seat to transition to crook portions of the crook staffs, said crook portion extending downwardly toward a said seat said downwardly extending crook portions being spaced from said staff portions, said downwardly extending crook portions being resiliently deformable toward said staff portions to vertically pass between them to be seated in a said seat a downwardly forced longitudinal rebar rod extending in the direction of said axis of a said seat, said downwardly extending crook portions of said crook staffs returning resiliently to an undeformed position after passage of said longitudinal rebar rod therebetween, said crook portions compressively and said staff portions tensilely resisting movement of a seated said longitudinal rebar rod out of a said seat, and (b) a plurality of longitudinal rebar rods received in said seats of said first and second bodies.

35. A method of constructing a continuously reinforced concrete paving, comprising:

(a) constructing, on the base of a roadbed to receive a pour of concrete, a rebar mat, comprising:

(1) a plurality of transverse rebar rods each arranged in a direction transverse to the length of a concrete paving to be poured and in parallel to one another, (2) a plurality of chairs for each said transverse rebar rod, each chair comprising:

(A) a body, (B) a support extending downwardly for spacing said body above a base, each said body further including:

(i) a horizontal bed having an axis oriented in a first axial direction and sides receiving a said transverse rebar rod in said first axial direction, (ii) a plurality of upwardly open horizontal seats having an axis stationarily oriented in a second axial direction orthogonal to said first axial direction, said seats having opposing sides and being positioned above said bed sufficiently to permit a longitudinal rebar rod to sit in said seats such that said longitudinal rebar rod is located immediately above said transverse rebar rod and oriented in said second axial direction, and (iii) at least one crook staff on one side of said seats and at least one crook staff on the opposite side of said seats, staff portions of such opposing crook staffs each extending above said seats to transition to crook portions of such crook staffs, said crook portions extending downwardly toward said seats, said downwardly extending crook portions being spaced from said staff portions, said downwardly extending opposing crook portions being resiliently deformable toward their corresponding staff portions to vertically pass between such opposing crook portions for seating in said seats a downwardly forced longitudinal rebar rod extending in the direction of said axis of said seats, said downwardly extending crook portions of said opposing crook staffs returning resiliently to an undeformed position after passage of said longitudinal rebar rod therebetween, said crook portions compressively and said staff portions tensilely resisting movement out of a said seat of a seated said longitudinal rebar rod, and (3) a plurality of longitudinal rebar rods received in said seats of said chairs, and (b) pouring concrete onto said roadbed and embedding said rebar mat in said concrete.

36. A method of constructing a continuously reinforced concrete paving using a transverse bar assembly, comprising:

(a) constructing on the base of a roadbed to receive a pour of concrete a rebar mat, comprising:

(1) a plurality of transverse rebar assemblies each arranged in a direction transverse to the length of a concrete paving to be poured and in parallel to one another, each transverse bar assembly comprising:

(A) a transverse rebar rod, (B) a plurality of first bodies each including a support extending downwardly for spacing said body above a base, each said body further including:

(i) a horizontal bed having an axis oriented in a first axial direction and sides receiving said transverse rebar rod in said first axial direction, (ii) a plurality of upwardly open horizontal seats having an axis stationarily oriented in a second axial direction orthogonal to said first axial direction, said seats having opposing sides and being positioned above said bed sufficiently to permit a longitudinal rebar rod to sit in said seats such that said longitudinal rebar rod is located immediately above said transverse rebar rod and oriented in said second axial direction, and (iii) at least one crook staff on one side of said seats and at least one crook staff on the opposite side of said seats, staff portions of such opposing crook staffs each extending above said seats to transition to crook portions of such crook staffs, said crook portions extending downwardly toward said seats said downwardly extending crook portions being spaced from said staff portions, said downwardly extending opposing crook portions being resiliently deformable toward their corresponding staff portions to vertically pass between such opposing crook portions for seating in said seats a downwardly forced longitudinal rebar rod extending in the direction of said axis of said seats, said downwardly extending crook portions of said opposing crook staffs returning resiliently to an undeformed position after passage of said longitudinal rebar rod therebetween, said crook portions compressively and said staff portions tensilely resisting movement out of a said seat of a seated said longitudinal rebar rod, and (C) a plurality of second bodies intermediate pairs of said first bodies, said second bodies having a horizontal bed with an axis oriented in said first axial direction and sides receiving and clasping said transverse rebar rod in said first axial, said second bodies each having:

(i) at least one upwardly open horizontal seat having an axis stationarily oriented in a second axial direction orthogonal to said first axial direction, said seat having opposing sides and being positioned above said bed sufficiently to permit a longitudinal rebar rod to sit in said seat such that said longitudinal rebar rod is located immediately above said transverse rebar rod and oriented in said second axial direction, and (ii) at least one crook staff on one side of said at least one seat and at least one crook staff on a side of a said seat opposite said one side, staff portions of said crook staffs each extending above said seat to transition to crook portions of the crook staffs, said crook portion extending downwardly toward a said seat said downwardly extending crook portions being spaced from said staff portions, said downwardly extending crook portions being resiliently deformable toward said staff portions to vertically pass between them to be seated in a said seat a downwardly forced longitudinal rebar rod extending in the direction of said axis of a said seat, said downwardly extending crook portions of said crook staffs returning resiliently to an undeformed position after passage of said longitudinal rebar rod therebetweed, said crook portions compressively and said staff portions tensilely resisting movement of a seated said longitudinal rebar rod out of a said seat, and (2) a plurality of longitudinal rebar rods received in said seats of said first and second bodies, and (b) pouring concrete onto said roadbed and embedding said rebar mat in said concrete.

37. A method of assembling a transverse bar assembly, comprising bonding to a transverse bar having raised elements on the surface thereof:

(a) a plurality of support bodies supporting said transverse bar for holding a longitudinal rod across said transverse bar, each support body being spaced along said transverse bar in said transverse direction and comprising:

(1) a support extending from said support body for spacing said support body above a said surface to receive a pour of concrete, (2) a support body horizontal bed having opposing round sides for receiving in an axial direction and at least anti-rotatively fastening an elongate transverse bar, (3) a plurality of upwardly open horizontal seats having opposing sides and a floor at an elevation above said bed orthogonal to said bed for accepting a longitudinal rod over and across a said transverse bar received in said horizontal support body bed, (4) at least one crook staff on one side of said seats and at least one crook staff on the opposite side of said seats, staff portions of such opposing crook staffs each extending above said seats to transition to crook portions of such crook staffs, said crook portions extending downwardly toward said seats said downwardly extending crook portions being spaced from said staff portion, said downwardly extending opposing croak portions being resiliently deformable toward their corresponding staff portions to vertically pass between such opposing crook portions for seating in said seats a downwardly forced longitudinal rebar rod extending in the direction of said axis of said seats, said downwardly extending crook portions of said opposing crook staffs returning resiliently to an undeformed position after passage of said longitudinal rebar rod therebetween, said crook portions compressively and said staff portions tensilely resisting movement out of a said seat of a seated said longitudinal rebar rod, and; and (b) a plurality of clip bodies for holding longitudinal rods across said transverse bar, said clip bodies being spaced along said transverse bar between adjacent support bodies on said transverse bar, each said clip body comprising (1) a horizontal clip body bed having opposing round sides for receiving in an axial direction and at least anti-rotatively fastening an elongate transverse bar, (2) at least one upwardly open horizontal clip body seat having opposing sides and a floor at an elevation above said clip body bed orthogonal to said clip body bed for accepting an elongate longitudinal rod over and across said transverse bar received in said horizontal clip body bed, (3) at least one crook staff on one side of said at least one seat and at least one crook staff on a side of a said seat opposite said one side, staff portions of said crook staffs each extending above said seat to transition to crook portions of the crook staffs, said crook portion extending downwardly toward a said seat said downwardly extending crook portions being spaced from said staff portions, said downwardly extending crook portions being resiliently deformable toward said staff portions to vertically pass between them to be seated in a said seat a downwardly forced longitudinal rebar rod extending in the direction of said axis of a said seat, said downwardly extending crook portions of said crook staffs returning resiliently to an undeformed position after passage of said longitudinal rebar rod there between, said crook portions compressively and said staff portions tensilely resisting movement of a seated said longitudinal rebar rod out of a said seat.

* * * * *